US007018762B2

(12) United States Patent
Kadota

(10) Patent No.: US 7,018,762 B2
(45) Date of Patent: Mar. 28, 2006

(54) TONER AND IMAGE FORMING APPARATUS USING THE SAME

(75) Inventor: Takuya Kadota, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/732,476

(22) Filed: Dec. 11, 2003

(65) Prior Publication Data

US 2004/0265720 A1 Dec. 30, 2004

Related U.S. Application Data

(62) Division of application No. 10/029,393, filed on Dec. 28, 2001, now Pat. No. 6,686,110.

(30) Foreign Application Priority Data

| | | |
|---|---|---|
| Dec. 28, 2000 | (JP) | 2000-401294 |
| Dec. 28, 2000 | (JP) | 2000-401295 |
| Jan. 4, 2001 | (JP) | 2001-000089 |
| Feb. 9, 2001 | (JP) | 2001-033297 |
| Feb. 9, 2001 | (JP) | 2001-033298 |
| Feb. 9, 2001 | (JP) | 2001-033299 |
| Feb. 9, 2001 | (JP) | 2001-033300 |

(51) Int. Cl.
*G03G 9/08* (2006.01)

(52) U.S. Cl. ..... 430/108.6; 430/108.7; 430/111.4

(58) Field of Classification Search ..... 430/108.6, 430/108.7, 111.4
See application file for complete search history.

(56) References Cited

U.S. PATENT DOCUMENTS

| | | | | |
|---|---|---|---|---|
| 5,066,558 | A | 11/1991 | Hikake et al. | |
| 5,659,858 | A | 8/1997 | Kunugi | |
| 6,146,802 | A | 11/2000 | Okada et al. | |
| 6,383,704 | B1 * | 5/2002 | Kataoka et al. | 430/108.6 |

FOREIGN PATENT DOCUMENTS

| | | |
|---|---|---|
| EP | 0 977 092 A2 | 2/2000 |
| EP | 1 003 080 A1 | 5/2000 |
| JP | 63-208862 | 8/1988 |

(Continued)

*Primary Examiner*—Mark A. Chapman
(74) *Attorney, Agent, or Firm*—Sughrue Mion, PLLC

(57) ABSTRACT

In a toner T of the present invention, the liberated mother particle ratio is set to be 10% or less and the liberated silica particle ratio is set to be 0.2–10%, thereby reducing the possibility that the liberated mother particles 18' and the mother particles 18 with silica particles 19 therein will be fused on toner-contact members such as a latent image carrier, a toner carrier, and a toner regulating member, and thus effectively preventing the filming of toner T. Therefore, according to the toner T of the present invention, the durability of the toner-contact members such as the latent image carrier, the toner carrier, and the toner regulating member can be improved. In addition, a large quantity of heat for heat fixing can be prevented from being consumed by the silica particles 19 because the amount of silica particles 19 is suitably set, and heat can be hardly transferred to mother particles 18 having a low melting point because the mother particles 18 are coated with a desired amount of silica particles 19. Therefore, the low-temperature fixing property can be improved.

11 Claims, 6 Drawing Sheets

FOREIGN PATENT DOCUMENTS

| | | |
|---|---|---|
| JP | 08-022139 | 1/1996 |
| JP | 09-197714 | 7/1997 |
| JP | 10-326028 | 12/1998 |
| JP | 11-174734 | 7/1999 |
| JP | 11-202557 | 7/1999 |
| JP | 11-258847 | 9/1999 |
| JP | 2000-047479 | 2/2000 |
| JP | 2000-292966 | 10/2000 |
| JP | 2000-352838 | 12/2000 |

* cited by examiner (a)

(b)

TONER AND IMAGE FORMING APPARATUS USING THE SAME

This is a divisional of application Ser. No. 10/029,393 filed Dec. 28, 2001 now U.S. Pat. No. 6,686,110; the disclosure of which is incorporated herein by reference.

BACKGROUND OF THE INVENTION

The present invention relates to a toner, composed of a plurality of mother particles and a plurality of external additive particles such as particles of silica, for developing an electrostatic latent image formed on a latent image carrier, and to an image forming apparatus for forming an image using the toner.

More particularly, the present invention relates to a toner, in which at least a plurality of particles of silica are used as an external additive and which has a function of preventing filming of toner to toner-contact members such as a latent image carrier, a toner carrier, and a toner regulating member, with which the toner may come in contact, thereby improving the durability of toner-contact members and also allowing the low-temperature fixing to be conducted well.

Further, the present invention relates to a toner in which at least a plurality of particles of titanium oxide or particles of alumina are used as an external additive and which is capable of stabilizing the charging property of toner, and to an image forming apparatus using this toner.

In an image forming apparatus using a toner, an image is obtained by developing an electrostatic latent image on a latent image carrier by a toner, transferring the developed image from the latent image carrier to a recording media such as paper to form a transferred image of the electrostatic latent image exposed on the latent image carrier, and finally fixing the transferred image to the recording media.

Among conventional image forming apparatuses, there is a multicolor image forming apparatus of intermediate transfer type as shown in FIG. 1. In an image forming apparatus 1 of this type, an image is exposed to light as an electrostatic latent image onto a photoreceptor 2 as a latent image carrier. The electrostatic latent image on the photoreceptor 2 is developed by yellow, magenta, cyan, and black non-magnetic mono-component developing devices 3, 4, 5, 6 in this order (the order of respective colors is arbitrary) so as to obtain visible developed images. The developed images on the photoreceptor 2 are superposed and toned on an intermediate transfer belt 7*a* of an intermediate transfer member 7, thus achieving primary transfer. After the primary transfer, the toned image is transferred to a recording media 9 such as a paper on a secondary transfer roller 8*a* of the transferring device 8, thus achieving secondary transfer. After that, the image is heated and fixed to the recording media 9 by a fixing device 10, thereby obtaining a desired image on the recording media 9.

Then, residual toner particles T' remaining on the photoreceptor 2 after the developed images are transferred to the intermediate transfer belt 7*a* are removed by a cleaning blade 11 and are collected in a residual toner box 12. Similarly, residual toner particles remaining on the intermediate transfer belt 7*a* after the primary transferred image is transferred to the recording media 9 are removed by a cleaning blade and are collected in a residual toner box.

The respective non-magnetic mono-component developing devices 3, 4, 5, 6 have substantially the same structure. That is, each of the developing devices 3, 4, 5, 6 is of a contact developing type that a conductive developing roller 16 is arranged in contact with the photoreceptor 2. As shown in FIG. 2(*a*), toner particles T in a toner container 13 are carried by a toner carrying means 14 to a toner supply roller 15 as toner supply means and is further supplied to the developing roller 16 by the toner supply roller 15. Accordingly, the toner particles T are held on the surface of the developing roller 16. A bias voltage composed of an alternating current superimposed on a direct current is applied to the developing roller 16 and the developing roller 16 is rotated at a high speed, whereby the toner particles T are regulated to be in a uniform thin layer by a toner regulating member 17 as toner regulating means, which is in press contact with the surface of the developing roller 16, and are uniformly charged. After that, the toner particles T on the developing roller 16 are uniformly conveyed toward the photoreceptor 2 which is in contact with the developing roller 16.

The toner particles T on the developing roller 16 is transferred to the photoreceptor 2 by developing voltage applied to the developing roller 16, whereby an electrostatic latent image is developed with the toner particles T on the photoreceptor 2.

The non-magnetic mono-component developing method employing conductive developing roller 16 also includes a non-contact developing method in which the developing roller 16 and a photoreceptor 2 are spaced apart from each other. In developing of the non-contact developing method, a developing voltage is applied to the developing roller 16 and toner particles T on the developing roller 16 is transferred by jumping to the photoreceptor 2 due to the developing voltage. That is, an electrostatic latent image on the photoreceptor 2 is developed with the toner particles T by jumping-developing.

In the conventional non-magnetic mono-component developing device, some toner particles T may be fused to toner-contact members, with which the toner may come in contact, such as the developing roller 16, the toner regulating blade 17, and/or the photoreceptor 2 or, alternatively, liberated external additive particles may be separated from the toner particles, thus leading to the occurrence of filming. Due to the filming, the insufficiency of toner carrying function of the developing roller 16, the insufficiency of regulating function of the toner regulating blade 17, and/or the insufficiency of developing function of the photoreceptor 2 may be occurred, thus further leading to degradation of image quality.

When the toner particles T are not uniformly charged, the insufficiency of toner carrying function of the developing roller 16, and/or the insufficiency of developing function of the photoreceptor 2 may be similarly occurred, thus further leading to similar problems.

To solve these problems, conventionally, resin mother particles 18 of the toner T are coated with external additive particles 19 as shown in FIG. 2(*b*). The size of the external additive particles 19 is set to be significantly smaller than the size of the mother particles 18.

Since use of a fixing device 10 for heat fixing enables the low-temperature fixing, conventionally, the mother particles 18 of the toner T have a low softening point so that the mother particles 18 are soft even at ordinary temperature.

On the other hand, in the conventional non-magnetic mono-component developing device, at least silica ($SiO_2$) 19 is added as the external additive 19 in order to prevent the occurrence of the filming.

Further, in the non-magnetic mono-component developing device, titanium oxide ($TiO_2$) 19 is added as the external additive 19 serving as a charge controlling agent as shown in FIG. 2(*b*) in order to stabilize the charge of the toner T.

Furthermore, in the non-magnetic mono-component developing device, alumina ($Al_2O_3$) 19 is added as the external additive 19 serving as a charge controlling agent and a cleaner as shown in FIG. 2(*b*) in order to stabilize the charge of the toner T and to clean the photoreceptor 2.

Particularly, most of conventional color toners employ a combination of silica and titanium oxide.

By the way, as for the aforementioned toner T, the external additive particles 19 adhere to the mother particles 18 by agitating the mother particles 18 and the external additive particles 19. As shown in FIG. 2(*b*), actually there are mother particles 18 and external additive particles 19 which adhere to each other (it should be noted that the numeral 18 is used for designating mother particles themselves as described above and also designating mother particles to which external additive particles 19 adhere and that the numeral 19 is used for designating external additive particles themselves as described above and also designating external additive particles adhering to mother particles), liberated mother particles 18' to which no external additive particle 19 adheres, and liberated external additive particles 19' adhering no mother particle 18 and they exist in the mixed state.

However, particularly for mother particles 18 having a low softening point, since the mother particles 18 are relatively soft, when the rate of the liberated mother particles 18' in the toner T are increased, the liberated mother particles 18' are fused to the aforementioned toner-contact members, thus facilitating the occurrence of filming and thus reducing the durability of the toner-contact members.

It may be considered to increase the adding amount of the external additive particles 19 to reduce the amount of the liberated mother particles 18'. When silica ($SiO_2$) 19 is employed as the external additives, the increase in the amount of silica particles 19 facilitates silica particles 19 to enter in the mother particles 18 because the mother particles 18 are relatively soft. When the silica particles 19 enter in the mother particles 18, the effect of the silica particles 19 coating the mother particles 18 is reduced. Therefore, the toner particles T are fused onto the toner-contact members, thus facilitating the occurrence of filming and thus reducing the durability of the toner-contact members in the same manner as mentioned above.

In addition, as the adding amount of silica particles 19 is increased, the amount of liberated silica particles 19' as the liberated external additives 19' is also increased. Therefore, the liberated silica particles 19' may adhere to the toner-contact members, thus also leading to the occurrence of filming.

Moreover, as the amount of silica particles 19 is increased, not only a large quantity of heat for heat fixing is consumed by the silica particles 19, but also heat is hard to be transferred to the mother particles 18 because the mother particles 18 are coated with many silica particles 19. As a result, it is easy to be subjected to deterioration of low-temperature fixing property. In addition, the coating on the mother particles 18 by the silica particles 19 blocks the elution of releasing agent, thus leading to the deterioration of fixing property.

When titanium oxide 19 is employed as the external additive 19 in the toner T (it should be noted that the numeral 18 is used for designating mother particles themselves as described above and also designating mother particles to which titanium oxide particles 19 adhere and that the numeral 19 is used for designating titanium oxide particles themselves as described above and also designating titanium oxide particles adhering to mother particles), the titanium oxide particles 19 adhere to the mother particles 18 by mixing or agitating the mother particles 18 and the titanium oxide particles 19. As shown in FIG. 2(*b*), actually there are mother particles 18 and titanium oxide particles 19 which adhere to each other, liberated mother particles 18' to which no titanium oxide particle 19 adheres, and liberated titanium oxide particles 19' adhering no mother particle 18 and they exist in the mixed state.

However, the increase in the amount of liberated mother particles 18' leads to excessive charge due to liberated mother particles 18', thus producing the insufficiency of development.

It may be considered to increase the adding amount of the titanium oxide particles 19 to reduce the amount of the liberated mother particles 18'. However, the increase in the amount of titanium oxide particles 19 leads to insufficient charge, thus bringing about image defects and toner scattering.

In addition, as the adding amount of titanium oxide particles 19 is increased, the amount of liberated titanium oxide particles 19' is also increased. Therefore, the liberated titanium oxide particles 19' may adhere to the toner-contact members, thus facilitating the occurrence of filming.

When alumina 19 is employed as the external additive 19 in the toner T (it should be noted that the numeral 18 is used for designating mother particles themselves as described above and also designating mother particles to which alumina particles 19 adhere and that the numeral 19 is used for designating alumina particles themselves as described above and also designating alumina particles adhering to mother particles), the alumina particles 19 adhere to the mother particles 18 by mixing or agitating the mother particles 18 and the alumina particles 19. As shown in FIG. 2(*b*), actually there are mother particles 18 and alumina particles 19 which adhere to each other, liberated mother particles 18' to which no alumina particle 19 adheres, and liberated alumina particles 19' adhering no mother particle 18 and they exist in the mixed state.

However, as mentioned above, the increase in the amount of liberated mother particles 18' in the toner T leads to excessive charge due to liberated mother particles 18', thus producing the insufficiency of development. For this, it may be considered to increase the adding amount of the alumina particles 19 to reduce the amount of the liberated mother particles 18'. However, since the increase in the amount of alumina particles 19 increases the amount of liberated alumina particles 19', the liberated alumina particles 19' adhere to the toner-contact members, thus facilitating the occurrence of filming.

In addition, since the alumina 19 has a function of controlling the charging property of the toner, the increase in the amount of alumina particles 19 deteriorates the charging property of the toner.

On the other hand, conventional toners include polymerized toners which are prepared by a polymerization method and pulverized toners which are prepared by a pulverization method and are rounded by heat treatment. Mother particles of these toners have relatively large roundness of 0.95 or more and are approximately formed in spheres. In the mother particles 18 having a low softening point particularly, the larger the roundness of a mother particle 18 is, the more spherical the mother particle 18 is. In this state, the mother particles 18 of the residual toner T' remaining on the photoreceptor 2 or the intermediate transfer belt 7*a* after transferred may pass through a space between the cleaning blade 11 and the photoreceptor 2 or between the cleaning blade 11 and the intermediate transfer belt 7*a*, that is, may not be removed by the cleaning blade 11, thus deteriorating the cleaning property of the cleaning blade 11. As a result of this, these particles remain adhering to the photoreceptor 2 and/or the intermediate transfer belt 7*a*, thus leading to the occurrence of filming. This reduces the durability of the photoreceptor 2 and the intermediate transfer belt 7*a* as the toner-contact members.

As the amount of liberated external additive particles 19' in the toner T is increased, it is difficult to effectively coat the mother particles 18 with the external additive particles 19. Accordingly, as mentioned above, the mother particles 18 are easily fused on the toner-contact members, thus facilitating the occurrence of filming. In addition, liberated external additives 19' easily adhere to the toner-contact members because the liberated external additive particles 19' are many, thereby also facilitating the occurrence of filming and thus decreasing the durability of the toner-contact members.

Moreover, many liberated external additive particles 19' easily soil the inside of each developing device 3, 4, 5, 6. Particularly, once charging members, such as the developing roller 16 and the toner regulating blade 17, for charging the toner T, are coated with the liberated external particles 19', it is hard to charge the toner T, thereby reducing the charging property of the toner T.

When the amount of liberated external additive particles 19' is small, not only a large quantity of heat for heat fixing is consumed by the external additive particles 19, but also heat is hard to be transferred to the mother particles 18 because the mother particles 18 are coated with many external additive particles 19. As a result, it is easy to be subjected to deterioration of low-temperature fixing property and the elution of releasing agent is blocked, thus leading to the deterioration of fixing property.

There is another problem that external additive particles may enter in mother particles so that components having low melting point of the mother particles soil the toner-contact members.

When the amount of liberated external additive particles 19' is small, the liberated external additive particles 19' can not exhibit the effect of cleaning the toner-contact members such as the photoreceptor 2 and the intermediate transfer belt 7*a*.

Generally, there are a large number of mother particles 18 of which particle diameter is about 1.5 μm or more. The smaller the particle diameter is, the lower the roundness of the mother particle 18 is. This is due to some problems on production of toners T such as in the pulverization method. With lower roundness, the mother particle 18 may have not only increased portions (e.g. sharp edges) to which the external additive particles 19 hardly adhere but also concaved portions in which the external additive particles 19 may enter, thereby hardly exhibiting the effect of the external additive particles 19.

As the amount of liberated mother particles 18' in the toner T is increased, the liberated mother particles 18' easily adhere to the toner-contact members. In addition, since the number of external additive particles 19 adhering to the mother particles 18 is reduced, the mother particles 18 not the liberated mother particles 18' also easily adhere to the toner-contact members. As the mother particles 18 adhere to the toner-contact members, filming occurs on the toner-contact members, thus reducing the durability of the toner-contact members. The mother particles 18 having a low softening point especially easily adhere to the toner-contact members because of the mother particles 18 are relatively soft, thus facilitating the occurrence of filming on the toner-contact members. In addition, since micro particles as mother particles 18 adhering to the toner-contact members are further hardly removed, the possibility of occurrence of filming on the toner-contact members is increased.

When titanium oxide particles adhere to the mother particles 18 strongly in comparison to silica particles, the toner can not be charged uniformly, thus deteriorating the uniformity of charging. The reason why the uniformity of charging is deteriorated may be that the titanium oxide particles hardly move in comparison to the silica particles.

SUMMARY OF THE INVENTION

It is an object of the present invention to provide a toner, employing at least either of silica and titanium oxide as external additives, which is capable of effectively preventing the occurrence of filming on toner-contact members such as a toner carrier, a toner regulating member, and a latent image carrier and thus improving the durability of the toner-contact members and the toner charging property, and to provide an image forming apparatus employing this toner.

It is another object of the present invention to provide a toner which is capable of preventing the occurrence of filming on the toner-contact members and still achieving satisfactory low-temperature fixing, and to provide an image forming apparatus employing this toner.

It is further another object of the present invention to provide a toner, employing at least titanium oxide as an external additive, which has improved charging property, and to provide an image forming apparatus employing this toner.

It is still another object of the present invention to provide a toner, employing at least alumina as an external additive, which has improved stable charging property and is capable of effectively cleaning a latent image carrier, and to provide an image forming apparatus employing this toner.

It is yet another object of the present invention to provide a toner which is capable of providing satisfactory effect of cleaning toner-contact members as a result of liberated external additive particles even with mother particles having large roundness, and to provide an image forming apparatus employing this toner.

It is another object of the present invention to provide a toner which is capable of preventing the occurrence of filming on toner-contact members such as a toner carrier, a toner-regulating member, and a latent image carrier by achieving uniform adhesion of external additive particles to mother particles, which are micro particles, as possible, and to provide an image forming apparatus employing this toner.

It is another object of the present invention to provide a toner which is capable of preventing the occurrence of filming on toner-contact members such as a toner carrier, a toner regulating member, and a latent image carrier and capable of improving the charge uniformity and to provide an image forming apparatus employing this toner.

To achieve the aforementioned objects, a toner of the present invention comprises, at least, a plurality of mother particles and a plurality of silica particles, and is characterized in that the liberated mother particle ratio of liberated mother particles without silica particle adhering thereto is set to be 10% or less and the liberated silica particle ratio of liberated silica particles adhering to none of the mother particles is set to be 0.2–10%.

The toner of the present invention is characterized in that the silica particles are surface treated with HMDS.

Further, a toner of the present invention comprises, at least, a plurality of mother particles and a plurality of titanium oxide particles, and is characterized in that the liberated mother particle ratio of liberated mother particles without titanium oxide particle adhering thereto is set to be 30% or less and the liberated titanium oxide particle ratio of liberated titanium oxide particles adhering to none of the mother particles is set to be 5% or less.

Furthermore, a toner of the present invention comprises, at least, a plurality of mother particles and a plurality of alumina particles, and is characterized in that the liberated mother particle ratio of liberated mother particles without alumina particle adhering thereto is set to be 30% or less and the liberated alumina particle ratio of liberated alumina particles adhering to none of the mother particles is set to be 0.2–5%.

Moreover, a toner of the present invention comprises, at least, a plurality of mother particles and a plurality of external additive particles in which the roundness of the mother particles is 0.95 or less, and is characterized in that the liberated external additive particle ratio of liberated external additive particles adhering to none of the mother particles is set to be 0.2–5%. The toner of the present invention is characterized in that said external additive particles are silica particles. In addition, the toner of the present invention is characterized in that said mother particles are pulverized toner particles prepared by the pulverization.

Further, a toner of the present invention comprises, at least, a plurality of mother particles and a plurality of external additive particles in which the roundness of the mother particles is 0.95 or more, and is characterized in that the liberated external additive particle ratio of liberated external additive particles adhering to none of the mother particles is set to be 3–10%. The toner of the present invention is characterized in that said external additive particles are silica particles. In addition, the toner of the present invention is characterized in that said mother particles are polymerized toner particles which are prepared by a polymerization method or pulverized rounded toner particles which are prepared by a pulverization method and processed by rounding treatment.

Furthermore, a toner of the present invention comprises, at least, a plurality of mother particles and a plurality of external additive particles, and is characterized in that the liberated mother particle ratio of liberated mother particles without external additive particle adhering thereto is set to be 15% or less, and the roundness of micro particles of 1.5–2.5 μm in diameter as some of said mother particles is set to be 0.85–0.95. The toner of the present invention is characterized in that said external additive particles are silica particles.

Furthermore, a toner of the present invention comprises, at least, a plurality of mother particles and a plurality of external additive particles, and is characterized in that the external additive particles contain at least silica particles and titanium oxide particles, and said external additive particles are set such that the absolute deviation in synchronous distribution of said silica particles relative to said mother particles is smaller than the absolute deviation in synchronous distribution of said titanium oxide particles relative to said mother particles.

On the other hand, an image forming apparatus of the present invention comprises at least a latent image carrier on which an electrostatic latent image is formed; and a developing device having a toner carrier for carrying a toner to develop the electrostatic latent image on said latent image carrier, and a toner regulating means for at least regulating the toner to be carried toward said latent image carrier by said toner carrier, and is characterized in that said toner is a toner of the present invention as described above.

In the toner T of the present invention mentioned above, the liberated mother particle ratio is set to be 10% or less and the liberated silica particle ratio is set to be between 0.2% and 10%, the amount of liberated mother particles and the amount of liberated silica particles can be suitably set relative to the entire amount of the toner. As a result, the amount of the silica particles adhering to the mother particles is also suitably set, thereby reducing the possibility that the liberated mother particles, the liberated silica particles, and the mother particles with silica particles therein will be fused on the toner-contact members such as the latent image carrier, the toner carrier, and the toner regulating member, and thus effectively preventing the filming of toner. Therefore, according to the toner of the present invention, the durability of the toner-contact members such as the latent image carrier, the toner carrier, and the toner regulating member can be improved and the image quality can be also improved.

Further, in the toner of the present invention, the amount of silica particles adhering to mother particles is suitable because the amount of liberated mother particles and the amount of liberated silica particles are suitably set, thereby preventing a large quantity of heat for heat fixing from being consumed by the silica particles. In addition, the mother particles are coated with a desired amount of silica particles, thus preventing the surfaces of the mother particles having a low melting point from being over-exposed. Therefore, according to the toner T of the present invention, the filming of the toner T onto the toner-contact members can be prevented and the low-temperature fixing property can be improved.

Furthermore, in the toner of the present invention, the silica particles are surface treated with HMDS so that the toner T has hydrophobic property. The hydrophobic property improves the fluidity of the toner like powder, thereby effectively preventing the occurrence of filming of the toner T.

In the toner of the present invention, the liberated mother particle ratio is set to be 30% or less and the liberated titanium oxide particle ratio is set to be 5% or less, whereby the amount of liberated mother particles and the amount of liberated titanium oxide particles can be suitably set relative to the entire amount of the toner. Therefore, the amount of the titanium oxide particles adhering to the mother particles is also suitably set so that excess charge of the liberated mother particles can be prevented and the charging property of the toner can be thus stabilized, thereby preventing the toner scattering and performing excellent development. As a result, high-quality images can be obtained.

In the toner of the present invention, the amount of the titanium oxide particles adhering to the mother particles is suitably set, thereby reducing the possibility that the liberated mother particles, the liberated titanium oxide particles, and the mother particles with titanium oxide particles therein will be fused on the toner-contact members such as the latent image carrier, the toner carrier, and the toner regulating member, and thus effectively preventing the filming of toner. Therefore, according to the toner of the present invention, the durability of the toner-contact members such as the latent image carrier, the toner carrier, and the toner regulating member can be improved and the image quality can be also improved.

In the toner of the present invention, the liberated mother particle ratio is set to be 30% or less and the liberated alumina particle ratio is set to be 0.2–5%, whereby the amount of liberated mother particles and the amount of liberated alumina particles can be suitably set relative to the entire amount of the toner, thereby stabilizing the charging property of the toner, preventing the fogging, and yet allowing effective cleaning of the latent image carrier.

Further in the toner of the present invention, the amount of the alumina particles adhering to the mother particles is suitably set because the amount of liberated alumina particles is suitably set, thereby reducing the possibility that the liberated mother particles, the liberated alumina particles, and the mother particles with alumina particles therein will be fused on the toner-contact members such as the latent image carrier, the toner carrier, and the toner regulating member, and thus effectively preventing the filming of toner. Therefore, according to the toner of the present invention, the durability of the toner-contact members such as the latent image carrier, the toner carrier, and the toner regulating member can be improved and the image quality can be also improved.

In the toner T of the present invention, the roundness of the mother particles is set to be 0.95 or less and the liberated additive particle ratio is set to be 0.2–5%, whereby the mother particles are not too spherical. Accordingly, mother particles of residual toner after transferred hardly pass below a cleaning blade so that the residual toner particles can securely removed by the cleaning blade. Therefore, the occurrence of filming on the toner-contact members can be prevented, thereby improving the durability of the toner-contact members which are cleaned by the cleaning blade.

Further in the toner of the present invention, since the amount of liberated external additive particles is suitably set relative to the entire amount of the toner, the mother particles can be effectively coated with the external additive particles, thereby preventing the occurrence of filming on the toner-contact members due to fusion of mother particles. Since the amount of liberated external additive particles is enough, the liberated external additive particles adhere to the toner-contact members, thus making the occurrence of filming difficult. This also improves the durability of the toner-contact members.

In addition, the inside of developing devices are hardly soiled by liberated external additive particles. Particularly, charging members, such as toner carriers, toner regulating members in the developing devices, for charging the toner are prevented from being coated with external particles, thereby facilitating charging of the toner and thus improving the charging property of the toner.

According to the toner T of the present invention, the durability of the toner-contact members such as the latent image carrier, the toner carrier, and the toner regulating member can be improved and high-quality images can be obtained.

In addition, in the toner of the present invention, the mother particles are effectively coated with external additive particles, thereby preventing a large quantity of heat for heat fixing from being consumed by the external additive particles. Therefore, heat can be effectively transferred to the mother particles, so that the low-temperature fixing property can be improved and the releasing agent can be suitably eluted from the toner, thereby improving the fixing property.

Moreover, in the toner of the present invention, even external additive particles embedded in mother particles, the mother particles are effectively coated with external additive particles, thereby preventing low-melting components of the mother particles from soiling the toner-contact members.

In the toner of the present invention, the liberated additive particle ratio is set to be 3–10% in the toner of which the roundness of the mother particles is 0.95 or more. Therefore, in a toner of which mother particles are nearly equal to the perfect sphere as a polymerized toner which is prepared by polymerization or a pulverized toner which is prepared by a pulverization and are rounded by heat treatment, the amount of liberated external additive particles can be suitably set relative to the entire amount of the toner. Accordingly, even in case of a toner with such mother particles which are nearly equal to the perfect sphere, enough cleaning effect for the toner-contact members such as a photoreceptor can be obtained because the liberated external additive particles work as a trigger, thereby improving the cleaning property.

Further in the toner of the present invention, since the amount of liberated external additive particles is suitably set relative to the entire amount of the toner, the mother particles can be effectively coated with the external additive particles so that the mother particles are hardly fused on the toner-contact members, thereby preventing the occurrence of filming on the toner-contact members. According to the toner of the present invention, the durability of the toner contact members such as the latent image carrier, the toner carrier, and the toner regulating member can be improved and high-quality images can be obtained.

In the toner of the present invention, the liberated mother particle ratio is set to be 15% or less in the toner of which the roundness of the micro particles of 1.5–2.5 μm as mother particles is set to be between 0.85 and 0.95. Therefore, in a toner having a liberated mother particle ratio of 15% or less, the roundness of the micro particles as mother particles can be suitably highly set, thereby reducing possibility of fusion of liberated mother particles to the toner-contact members such as the latent image carrier, the toner carrier, and the toner regulating member. In addition, uniform adhesion of external additive particles to the mother particles which are micro particles is achieved, thereby effectively reducing possibility of fusion of the micro particles as mother particles on the toner-contact members. As a result, the occurrence of filming on the toner-contact members is effectively prevented. According to the toner of the present invention, the durability of the toner contact members such as the latent image carrier, the toner carrier, and the toner regulating member can be improved and high-quality images can be obtained over a long period.

In the toner of the present invention, silica is used as the external additive and, in addition, a suitable amount of silica particles can adhere to the mother particles, thereby preventing a large quantity of heat for heat fixing from being consumed by the silica particles. In addition, the mother particles are coated with a desired amount of silica particles, thus preventing the surfaces of the mother particles having a low melting point from being over-exposed. Therefore, according to this toner, the filming of the toner onto the toner-contact members can be prevented and the low-temperature fixing property can be improved.

In the toner of the present invention, the external additive particles are set such that the absolute deviation in synchronous distribution of the silica particles relative to the mother particles is smaller than the absolute deviation in synchronous distribution of the titanium oxide particles relative to the mother particles, thereby effectively preventing the occurrence of filming on the toner-contact members such as the toner carrier, toner regulating member, and latent image carrier, because of the function of silica for preventing occurrence of filming. In addition, the distribution of the titanium oxide particles having a charge control function is set to be larger than the distribution of the silica particles so that the titanium oxide particles easily move, thereby achieving uniform charge of the toner T because of the function of the titanium oxide particles. According to the toner of the present invention, the filming on the toner contact members can be prevented and the charge uniformity of the toner can be improved.

On the other hand, in the image forming apparatus of the present invention, by using the toner in which the amount of liberated mother particles and the amount of liberated silica particles, the durability of the toner-contact members such as the latent image carrier, the toner carrier, and the toner regulating member are improved and high quality images can be obtained. In addition, since the surfaces of mother particles having a low melting point are hardly exposed, the image forming apparatus of the present invention can provide excellent low-temperature fixing property while preventing the filming of toner on the toner-contact members.

Further, in the image forming apparatus of the present invention, by using the toner in which the amount of liberated mother particles and the amount of liberated titanium oxide particles are suitably set relative to the entire amount of the toner as mentioned above, the durability of the toner-contact members such as the latent image carrier, the toner carrier, and the toner regulating member are improved and high quality images can be obtained, because the filming of toner is effectively prevented.

Furthermore, in the image forming apparatus of the present invention, by using the toner in which the amount of liberated mother particles and the amount of liberated alumina particles are suitably set relative to the entire amount of the toner as mentioned above, the latent image carrier can be effectively cleaned. In addition, because the filming of toner is effectively prevented, the durability of the toner-contact members such as the latent image carrier, the toner carrier, and the toner regulating member are improved and high quality images can be obtained.

Moreover, in the image forming apparatus of the present invention, by using a toner in which the roundness of the mother particles is set to be 0.95 or less and the liberated additive particle ratio is set to be 0.2–5%, the durability of the toner-contact members such as the latent image carrier, the toner carrier, and the toner regulating member are improved, the charging property of toner is improved, and high quality images can be obtained.

Further, in the image forming apparatus of the present invention, by using a toner in which the roundness of the mother particles is 0.95 or more and the liberated additive particle ratio is set to be 3–10%, the durability of the toner-contact members such as the latent image carrier, the toner carrier, and the toner regulating member are improved and high quality images can be obtained.

Furthermore, in the image forming apparatus of the present invention, by using a toner in which the liberated mother particle ratio is set to be 15% or less in the toner of which the roundness of the micro particles of 1.5–2.5 μm as mother particles is set to be 0.85–0.95, the durability of the toner-contact members such as the latent image carrier, the toner carrier, and the toner regulating member are improved and high quality images can be obtained. In addition, because the surfaces of mother particles are hardly exposed so as to make heat hardly transferred to mother particles having a low melting point, the image forming apparatus of the present invention can prevent the occurrence of filming on the toner-contact members and yet obtaining excellent low-temperature fixing.

Moreover, in the image forming apparatus of the present invention, by using a toner in which the external additive particles are set such that the absolute deviation in synchronous distribution of the silica particles relative to the mother particles is smaller than the absolute deviation in synchronous distribution of the titanium oxide particles relative to the mother particles, the occurrence of filming on the toner-contact member in the apparatus can be prevented and the toner can be further uniformly charged, thereby obtaining high quality images.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

The embodiments of the present invention will be described hereinafter with reference to the drawings.

Figure 1:
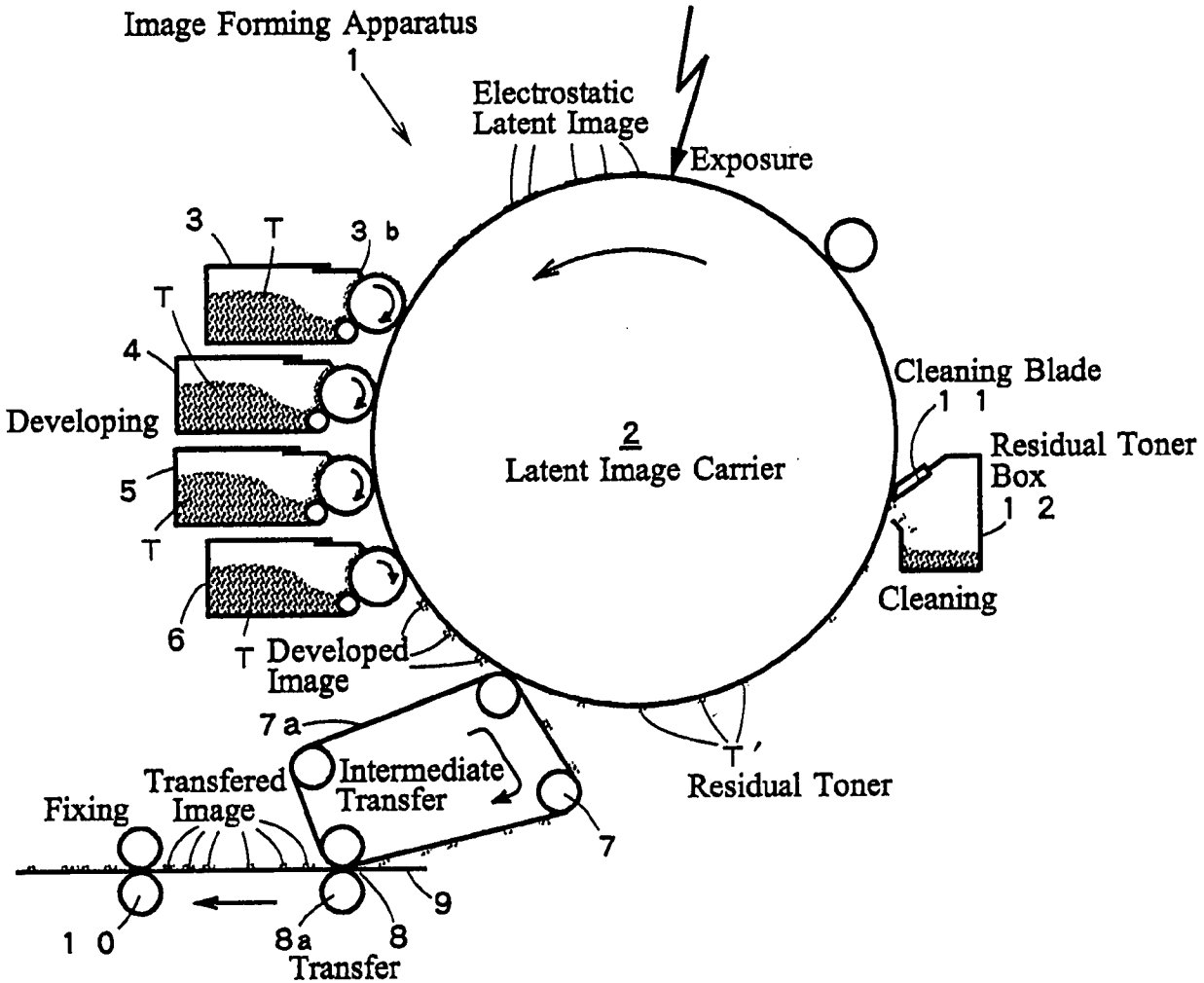
FIG. 1 is an illustration schematically showing a multicolor image forming apparatus of an intermediate transferring type, which is an example of a conventional image forming apparatus, and which is employed as an image forming apparatus used in embodiments according to the present invention.
Figure 2:
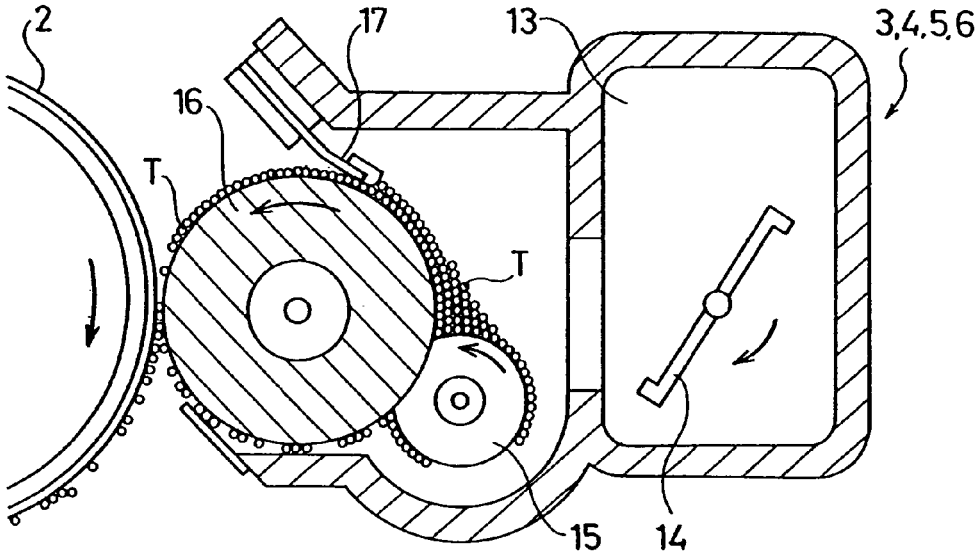
FIG. 2(*a*) is a sectional view schematically showing an example of a conventional developing device used in the image forming apparatus shown in FIG. 1 and FIG. 2(*b*) is a view of particles of a toner used in the image forming apparatus.
Figure 2:
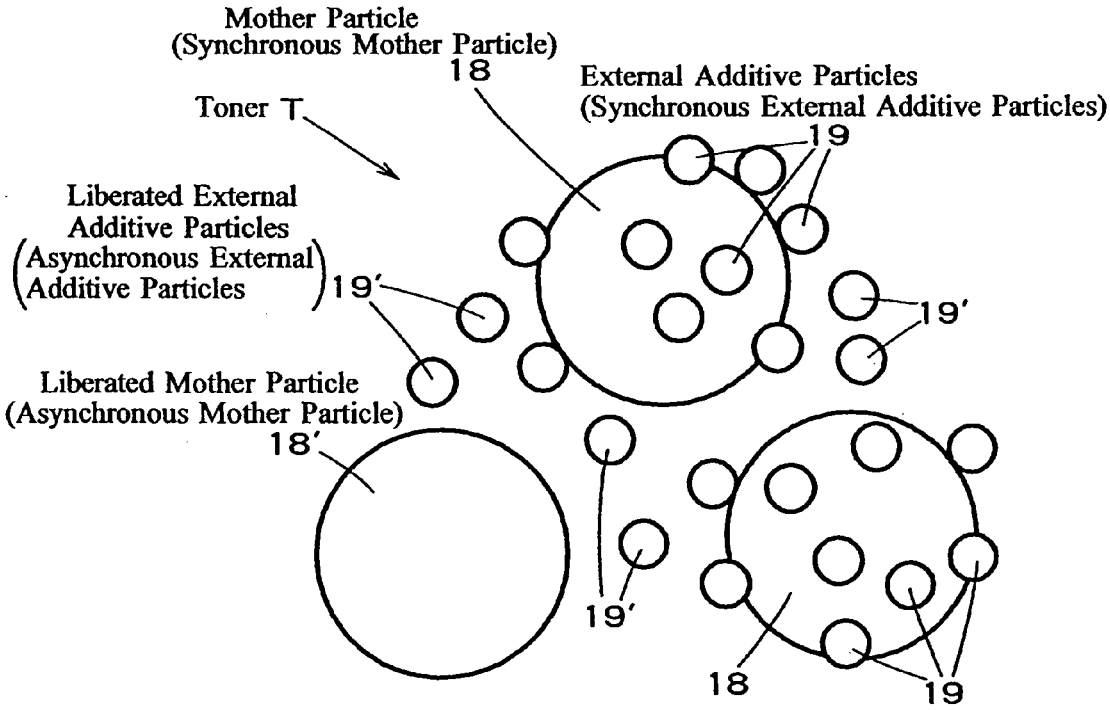

An image forming apparatus as an example of embodiments of the present invention has the same structure as shown in FIG. 1 and FIG. 2(*a*). Therefore, actions for forming an image of the image forming apparatus of this embodiment are the same as those of the aforementioned conventional apparatus.

An embodiment of the toner T of the present invention used in the image forming apparatus 1 of this embodiment will be described. The toner of this embodiment includes mother particles 18, which is made of resin having a low softening point and thus is soft at ordinary temperature, and at least silica particles 19 as an external additive 19. The liberated mother particle ratio of liberated mother particles 18' without silica particle 19 adhering thereto is set to be 10% or less. The liberated mother particle ratio is a percentage of the amount of the liberated mother particles 18' relative to the entire amount of the toner. In addition, the liberated silica particle ratio of liberated silica particles 19' adhering to none of the mother particles 18 is set to be 0.2–10%. The liberated silica particle ratio is a percentage of the amount of the liberated silica particles 19' relative to the entire amount of the toner. Moreover, the silica particles 19 are surface treated with HMDS (hexamethyldisilazane) so as to have hydrophobic property. The hydrophobic property improves the fluidity and the charging property of the toner like powder.

The flow softening point of the mother particles 18 of the toner T is preferably between 100° C. and 120° C. This is a reason that when the flow softening point of the mother particles 18 is lower than 100° C., the toner T gradually becomes easy to be fused onto the toner-contact members such as the developing roller 16, the toner regulating blade 17, and the photoreceptor 2. Though somewhat low flow softening point does not cause problems in practice, it is not preferable that the flow softening point is lower than that temperature. When the flow softening point of the mother particles 18 is higher than 120° C., the low-temperature fixing gradually becomes poor. Though somewhat high flow softening point does not cause problems in practice, it is not preferable that the flow softening point is higher than that temperature.

By the way, to obtain the aforementioned liberated mother particle ratio and the liberated silica particle ratio, it is necessary to analyze the state of adhesion between the mother particles 18 and the silica particles 19 to measure the amount of liberated silica particles 19' adhering to none of the mother particles 18, the amount of liberated mother particles 18' with no silica particles 19 adhering thereto, and the amount of mother particles 18 with some silica particles 19 adhering thereto. There are several conventional methods for analyzing toners. The image forming apparatus 1 according to this embodiment employs, for instance, a particle analyzing method as will be expressed as follows.

That is, the image forming apparatus 1 according to this embodiment employs a toner analyzing method (PT1000) which is disclosed in "A New Approach for the Additive Material Analysis—The Toner Measurement by Particle Analyzer—", Toshiyuki Suzuki and Toshio Takahara, collection of "Japan Hardcopy '97", the (95th) annual conference of the society of electrophotography of Japan, sponsored by the society of Electrophotography, Jul. 9–11, 1997.

Figure 3:
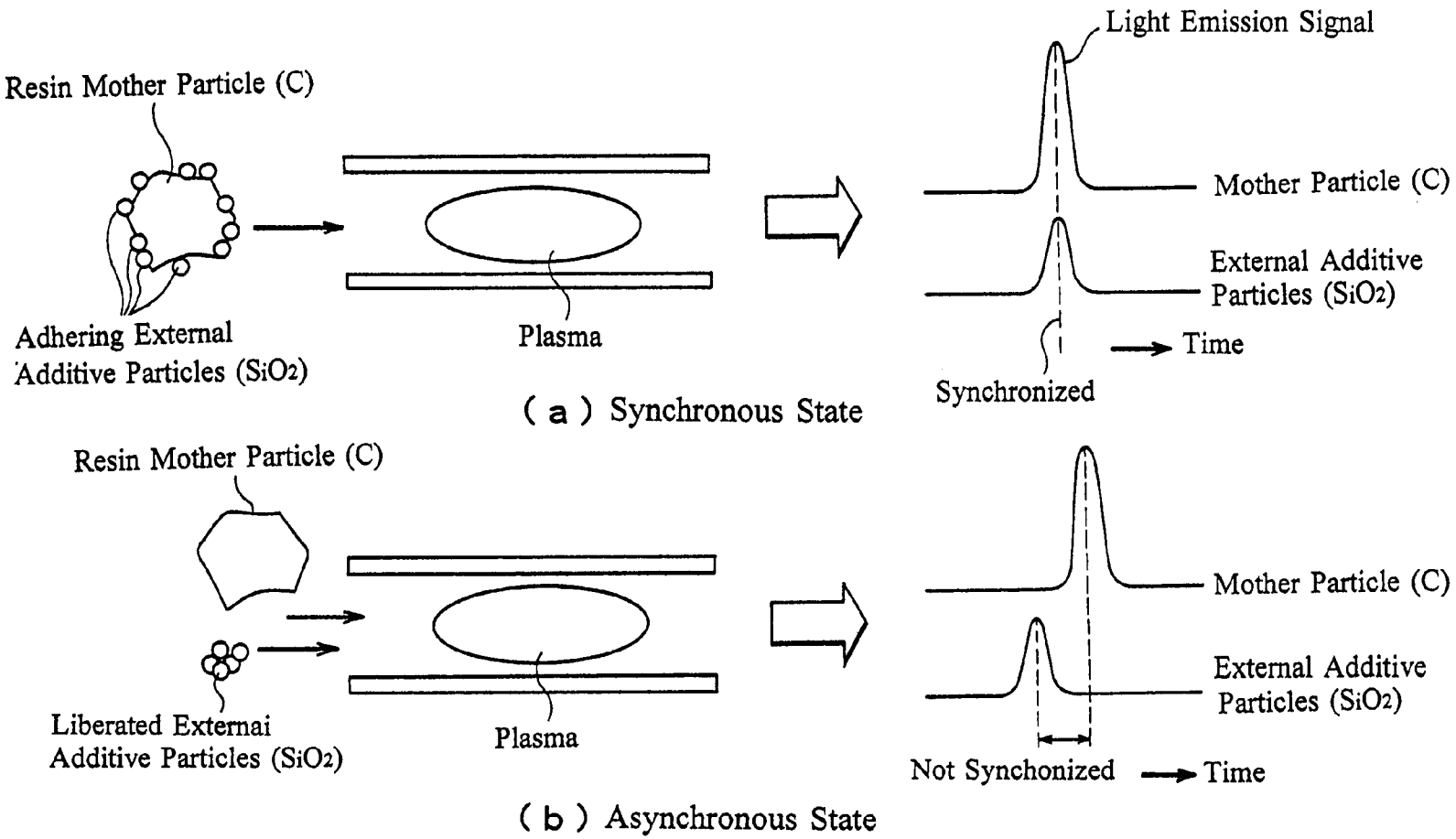
FIGS. 3(*a*) and 3(*b*) are views for explaining an example of a conventional toner analyzing method for analyzing a state of adhesion between mother particles and external additive particles of toner.

This toner analyzing method is an elementary analyzing method comprising the steps of introducing toner particles T, containing external additive particles 19 consisting of silica ($SiO_2$) adhering to the surfaces of mother particles 18 made of a resin (C), into plasma so as to excite the toner particles T and of obtaining emission spectrum as shown in FIGS. 3(*a*) and 3(*b*) owning to the excitation.

In the views shown in FIGS. 3(*a*), 3(*b*), an axis of abscissa showing emission spectrum stands for time axis. As shown in FIG. 3(*a*), introduction of toner particles T, in which external additive particles ($SiO_2$) adhere to mother particles (C) made of a resin of the toner T, into plasma causes both of the mother particles (C) and the external additive particles ($SiO_2$) to emit light. Since the mother particles (C) and the external additive particles ($SiO_2$) are simultaneously introduced into plasma, the mother particles (C) and the external additive particles ($SiO_2$) simultaneously emit light. The state in which the mother particles (C) and the external additive particles ($SiO_2$) simultaneously emit light is equal to the state in which the mother particles (C) and the external additive particles ($SiO_2$) are synchronized with each other. Namely, the state in which the mother particles (C) and the external additive particles ($SiO_2$) are synchronized with each other stands for the state in which the external additive particles ($SiO_2$) adhere to the mother particles (C).

In a state as shown in FIG. 3(*b*) in which mother particles (C), to which no external additive particles ($SiO_2$) adheres, and external additive particles ($SiO_2$) liberated from the mother particles (C) are introduced into plasma, both of the mother particles (C) and the external additive particles ($SiO_2$) emit light similarly to the aforementioned case. However, since the mother particles (C) and the external additive particles ($SiO_2$) are introduced into plasma at different times, the mother particles (C) and the external additive particles ($SiO_2$) emit light at different times (for instance, when the mother particles are introduced into plasma prior to the introduction of the external additive particles, the mother particles first emit light, and then the external additives emit light).

The state in which the mother particles (C) and the external additive particles ($SiO_2$) emit light at different times is equal to the state in which the mother particles (C) and the external additive particles ($SiO_2$) are not synchronized with each other (that is, an asynchronous state). Namely, the state in which the mother particles (C) and the external additive particles ($SiO_2$) are asynchronous with each other stands for a state in which the external additive particles ($SiO_2$) do not adhere to the mother particles (C), that is, the mother particles and external additive particles are liberated mother particles and liberated external additive particles, respectively.

Figure 4:
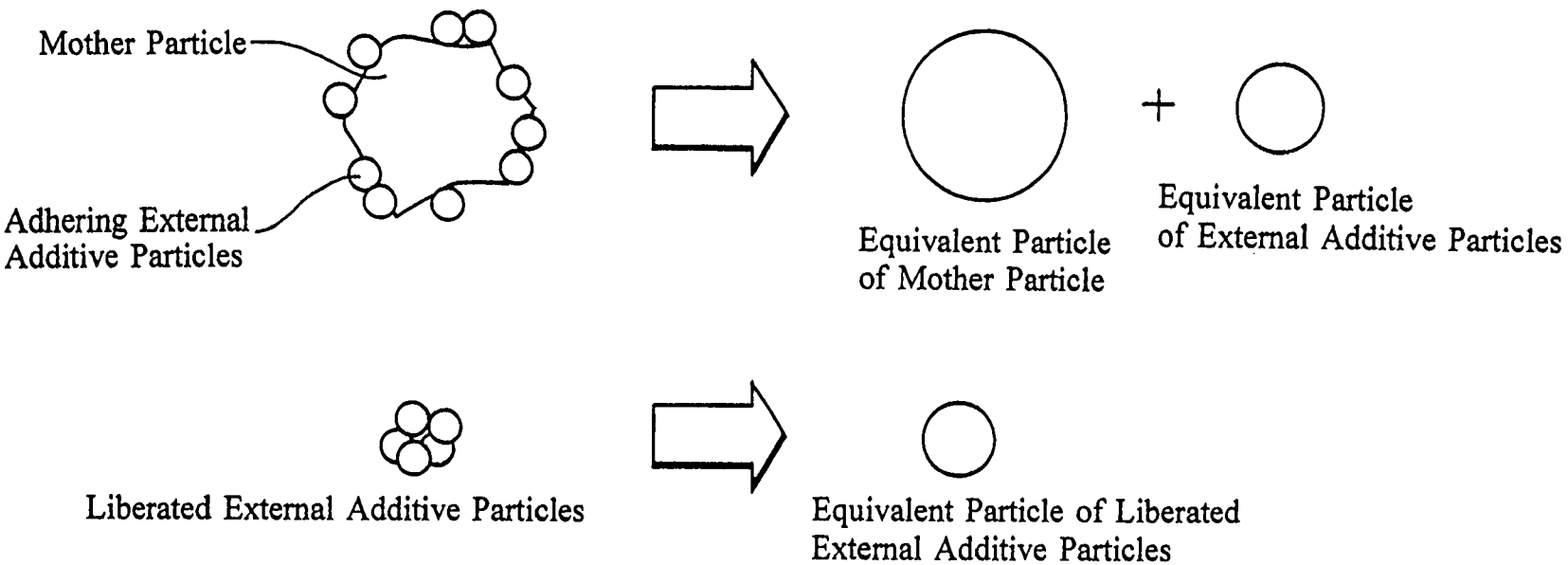
FIG. 4 is a view showing equivalent particles and equivalent particle diameters for use in the toner analyzing method shown in FIGS. 3(*a*), 3(*b*)

Referring to FIGS. 3(*a*), 3(*b*), the height of the light emission signal indicates the intensity of emitted light. The intensity of emitted light is proportional to the number of atoms of the elements (C and $SiO_2$) contained in the particles, not the size nor shape of the particles. To express the intensity of emitted light of the elements into the sizes of the particles, each mother particle (C) is assumed as a perfect sphere and adhering external additive particles ($SiO_2$) are assumed together as a perfect sphere during light emission of mother particle (C) and external additive particles ($SiO_2$) as shown in FIG. 4. In this manner, the intensity is expressed by the particle diameter of the mother particles (C) and the particle diameter of the external additive particles ($SiO_2$). The perfect spheres are called equivalent particles, and the particle diameter of each equivalent particle is called an equivalent particle diameter. Since the external additive particles having very small sizes cannot individually be detected, the detected light emission signals of the external additive particles are added together to be converted into one equivalent particle for analysis.

Figure 5:
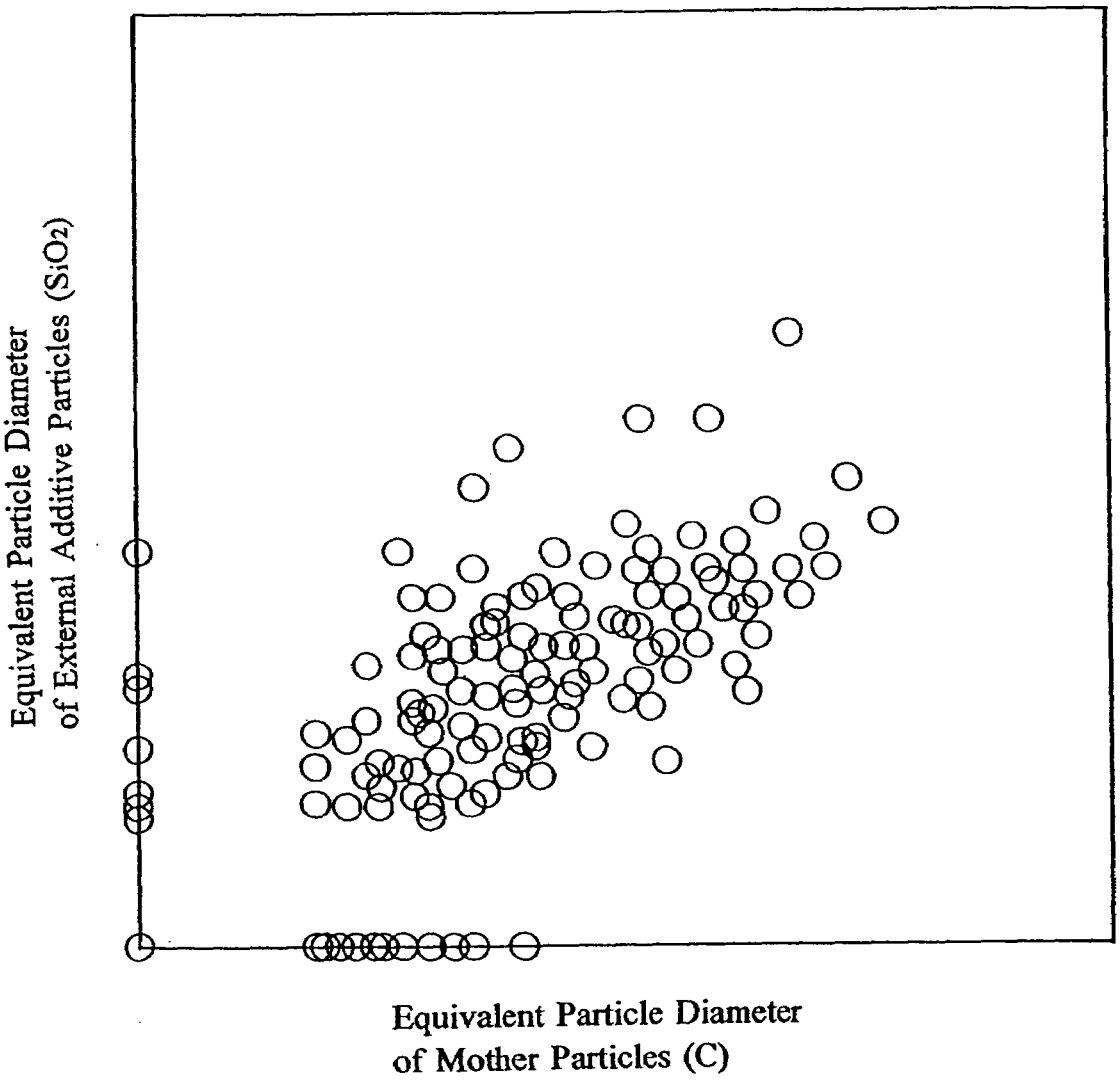
FIG. 5 is a graph showing results of analysis performed with the toner analyzing method shown in FIGS. 3(*a*), 3(*b*)

The equivalent particle diameter of the equivalent particle obtained from the respective emission spectrum of the mother particles and the external additive particles is plotted for each toner particle T, whereby a graph showing the distribution of equivalent particle diameters of the toner particles as shown in FIG. 5 is obtained.

In the graph shown in FIG. 5, an axis of abscissa stands for equivalent particle diameters of the mother particles (C) and an axis of ordinate which stands for equivalent particle diameter of the external additive particles ($SiO_2$). The equivalent particles indicated on the axis of abscissa represent asynchronous mother particles (C) to which no external additive particles ($SiO_2$) adhere. In this case, mother particles (C) to which external additive particles having concentration less than the predetermined additive concentration adhere are also indicated on the axis of abscissa. On the other hand, the equivalent particles indicated on the axis of ordinate represent asynchronous external additive particles ($SiO_2$) liberated from the mother particles (C). Equivalent particles deviated from the axis of abscissa and the axis of ordinate indicate synchronized toner particles T having the external additive particles ($SiO_2$) adhering the mother particles (C).

In this manner, the state of adhesion of the external additive particles ($SiO_2$) to the mother particles (C) of the toner T is analyzed.

Figure 6:
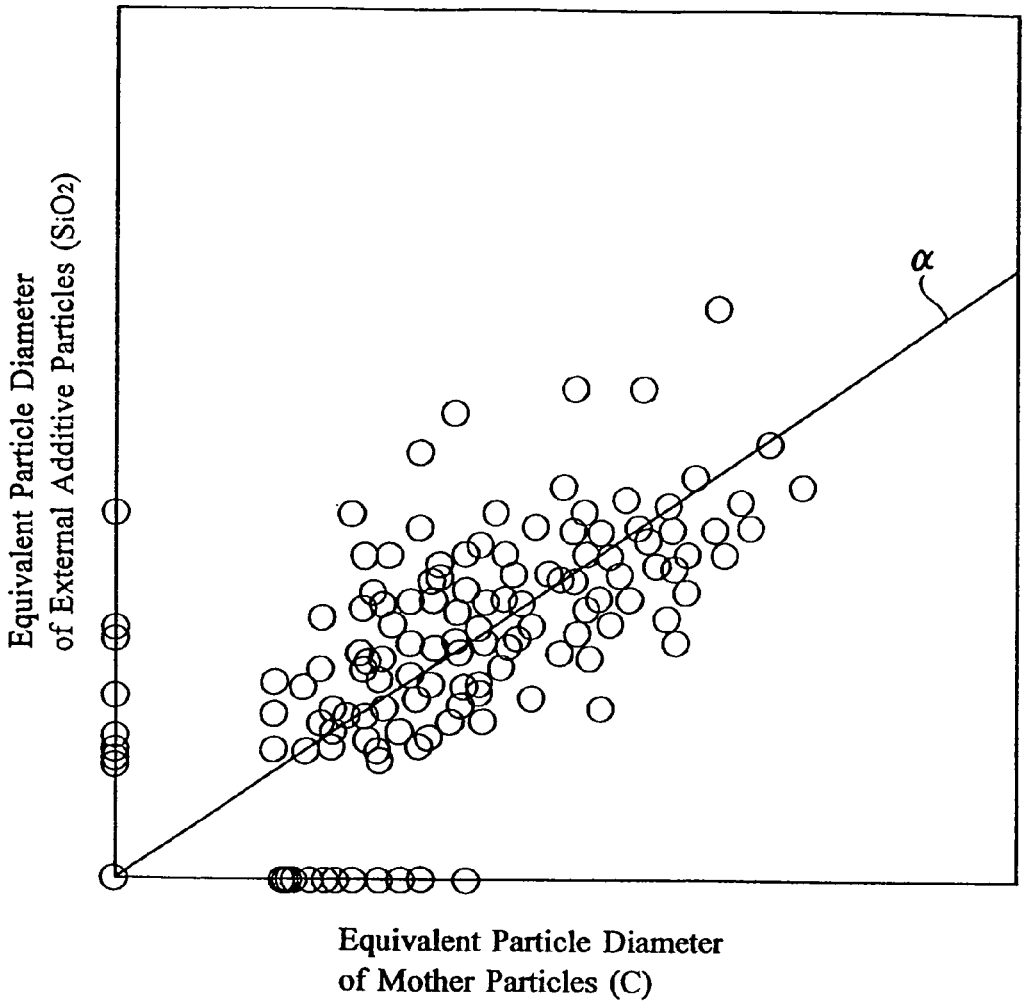
FIG. 6 is a graph showing a state of adhesion between mother particles and external additive particles of toner as a result obtained in the same manner as the analysis shown in FIG. 5, wherein the graph includes an approximation straight line α passing through the origin according to the least-square method.

As shown in FIG. 6, by employing the distribution map indicating equivalent particle diameters of the toner particles shown in FIG. 5, an approximation straight line $\alpha$ passing through the origin obtained by using the least-square method is employed for representing the state of adhesion between carbon (C) in the mother particles and the external additive particles ($SiO_2$) of the toner T. The inclination (equivalent particle diameter of the external additive particles/equivalent particle diameter of the mother particles) $\theta$ of the approximation straight line a represents the concentration of external additive particles ($SiO_2$) adhering to (synchronized with) the mother particles (C). That is, the gentler the inclination $\theta$ is, the smaller the amount of the synchronized external additive particles ($SiO_2$) is. The sharper the inclination $\theta$ is, the larger the amount of the synchronized external additive particles ($SiO_2$) is.

In the present invention, the liberated mother particle ratio and the liberated silica particle ratio are obtained from the state of adhesion of external additive particles ($SiO_2$) relative to the mother particles (C) of the toner T analyzed by using the distribution map indicating equivalent particle diameters of the toner particles shown in FIG. 5.

In the present invention, any other conventional analyzing method may be employed as the toner analyzing method besides the particle analyzing method by using the distribution map indicating equivalent particle diameters of the toner particles shown in FIG. 5. However, the particle analyzing method is preferable because the toner analysis can be conducted accurately and easily.

By the way, the toner T of this embodiment may be of a negative polarity or of a positive polarity. The mother particles comprises at least a coloring agent, an charge controlling agent, and other resin. Moreover, a dispersant, a releasing agent (WAX), a magnetic material, and other additives may be suitably added.

The material for the mother particles 18 has a low softening point, thus is relatively soft at ordinary temperature, and may be selected from a group consisting of: polystyrene and copolymers thereof, for example, hydrogenated styrene resin, styrene-isobutyrene copolymer, ABS resin, ASA resin, AS resin, AAS resin, ACS resin, AES resin, styrene-P-chlorostyrene copolymer, styrene-propylene copolymer, styrene-butadiene crosslinked polymer, styrene-butadiene-chlorinated paraffin copolymer, styrene-allyl-alcohol copolymer, styrene-butadiene rubber emulsion, styrene ester maleate copolymer, styrene-isobutylene copolymer, and styrene-maleic anhydride copolymer; acrylate resins and methacrylate resins and their copolymers; styrene-acrylic resins and their copolymers, for example, styrene-acryl copolymer, styrene-diethylamino-ethylmethacrylate copolymer, styrene-butadiene-acrylic ester copolymer, styrene-methylmethacrylate copolymer, styrene-n-butylacrylate copolymer, styrene-methylmethacrylate-n-butylmethacrylate copolymer, styrene-methylmethacrylate-butylarylate-N-(ethoxymethyl) acrylamide copolymer, styrene-glycidylmethacrylate copolymer, styrene-butadiene-dimethyl-aminoethylmethacrylate copolymer, styrene ester acrylic ester maleate copolymer, styrene-methyl methacrylate-acrylic acid-2-ethylhexyl copolymer, styrene-n-butylarylate-ethylglycolmethacrylate copolymer, styrene-n-butylmethacrylate-acrylic acid copolymer, styrene-n-butylmethacrylate-maleic anhydride copolymer, styrene-butyl acrylate-isobutyl maleate half ester-divinylbenzene copolymer; polyesters and copolymers thereof; polyethylene and copolymers thereof; epoxy resins; silicone resins; propylene and copolymers thereof; fluororesins; polyamide resins; polyvinyl alcohol resins; polyurethane resins; and polyvinylbutyral resin. Any one of the foregoing materials may be employed singly or a blend of any two or more materials may be employed.

The coloring agent may be carbon black, spirit black, nigrosine, rhodamine dyes, triaminotriphenylmethane, cation dyes, dioxazine, copper phthalocyanine, perylene, azo dyes, auriferous azo pigment, azochrome complex, carmine dyes, benzidine, solar pure yellow 8G, quinacridon, polytungstophosphate, Indanthrene Blue, sulfonamide derivative or the like.

The charge controlling agent may be an electron-acceptable organic complex, chlorinated polyester, nitrohumic acid, quaternary ammonium salt, or pyridinium salt.

The releasing agent may be polypropylene wax, polyethylene wax, ester wax, or the like.

The dispersant may be metallic soap, polyethylene glycol or the like.

Other additives may be zinc stearate, zinc oxide, cerium oxide or the like.

The magnetic material may be metal powder of Fe, Co, Ni, Cr, Mn or Zn; metal oxide, such as $Fe_3O_4$, $Fe_2O_3$, $Cr_2O_3$ or ferrite; an alloy, such as an alloy containing manganese and acid, which is provided with a ferromagnetic characteristic by heat treatment; or the like and may be previously treated by using a coupling material.

The foregoing materials are formed into the mother particles 18 by a usual kneading pulverization method, a spray and dry method, or a polymerizing method.

The external additive 19 may be silica only or may be silica mixed with inorganic fine particles, for example, fine particles of metal oxide such as alumina, titanium oxide, strontium titanic acid, cerium oxide, magnesium oxide, and chromic oxide, fine particles of nitride such as silicon nitride, fine particles of carbide such as silicon carbide, fine particles of metallic salt such as calcium sulfate, barium sulfate, calcium carbonate, and composites thereof; and/or organic fine particles, for example, acryl fine particles. As its surface treatment material, a silane coupling agent, a titanate coupling agent, a fluorine-contained silane coupling agent, or silicone oil may be employed besides HMDS. It is preferable that the particle diameter of the external additives 19 is 0.001 μm to 1 μm from a viewpoint of improving the transporting property and the charging property.

The mother particles 18 and the external additives 19 are mixed in a dry state so as to adhere to one another by using a high-speed fluidization mixing machine, such as a Henschel mixer or Perpen mayer or a mixing machine using a mechanochemical method.

According to the toner T of this embodiment as mentioned above, the liberated mother particle ratio is set to be 10% or less and the liberated silica particle ratio is set to be between 0.2% and 10%, the amount of liberated mother particles 18' and the amount of liberated silica particles 19' can be suitably set relative to the entire amount of the toner T. Therefore, the amount of the silica particles 19 adhering to the mother particles 18 is also suitably set, thereby reducing the possibility that the liberated mother particles 18', the liberated silica particles 19', and the mother particles 18 with silica particles 19 therein [particularly, resin and releasing agent (WAX) having a low melting point] will be fused on the photoreceptor 2, the developing roller 16, and/or the toner regulating blade 17, and thus effectively preventing the filming of toner. Therefore, according to the toner T, the durability of the photoreceptor 2, the developing roller 16, and the toner regulating blade 17 can be improved and the image quality can be also improved.

In addition, because of the suitably set amount of silica particles 19, not only a large quantity of heat for heat fixing can be prevented from being consumed by the silica particles 19, but also heat can be hardly transferred to mother particles 18 having a low melting point because the mother particles 18 are coated with a desired amount of silica particles 19. Therefore, according to the toner T of this embodiment, the filming of the toner T onto the photoreceptor 2, the developing roller 16, and the toner regulating blade 17 can be prevented and the low-temperature fixing property can be improved.

The silica particles 19 are surface treated with HMDS (hexamethyldisilazane) so that the toner T has hydrophobic property. The hydrophobic property improves the fluidity and the charging property of the toner like powder, thereby effectively preventing the occurrence of filming of the toner T mentioned above.

By using the aforementioned toner T, the image forming apparatus 1 of the present invention has improved durability of the photoreceptor 2, the developing roller 16, and the toner regulating blade 17 and can provide high quality images.

When there is no filming of toner T on any of the photoreceptor 2, the developing roller 16, and the toner regulating blade 17 even after printing 10K (1K=1000) sheets of paper, "Good" was given for evaluation. When there is any filming of toner T on either one of the photoreceptor 2, the developing roller 16, and the toner regulating blade 17 before printed 10K sheets of paper, "No Good" was given for evaluation.

As shown in Table 1, the toners of Examples 1 through 3 belonging to the present invention and the toners of Comparative Examples 1 through 3 not belonging to the present invention were pulverized toners of which used mother particles 18 were prepared by the pulverization and silica ($SiO_2$) which was TG810G (available from Cabot Corporation) was used as the external additive. The examples were prepared under the same adhesion condition that a mixer used for adhesion of the silica particles to the mother particles 18 was Henshel 20C (manufactured by Mitsui Mining Company, Ltd.), the revolution speed of the mixer was 2850 rpm., and the adding amount was 1.0 part by weight.

The time period taken for the additive adhesion was four minutes in Example 1, six minutes in Example 2, three minutes in Example 3, one minute in Comparative Example 1, two minutes in Comparative Example 2, and ten minutes in Comparative Example 3.

TABLE 1

| | | Example 1 | Example 2 | Example 3 | Comparative Example 1 | Comparative Example 2 | Comparative Example 3 |
|---|---|---|---|---|---|---|---|
| Mother Particles | | Pulverized Toners | ← | ← | ← | ← | ← |
| Silica (External Additive) | | TG810G*1 | ← | ← | ← | ← | ← |
| Additive | Mixer | Henshel 20C*2 | ← | ← | ← | ← | ← |
| Adhesion | Revolution Speed | 2850 rpm | ← | ← | ← | ← | ← |
| Condition | Adding Amount | 1.0 part by weight | ← | ← | ← | ← | ← |
| | Time Period | 4 min | 6 min | 3 min | 1 min | 2 min | 10 min |
| | Liberated Mother Particle Ratio % | 7.7 | 5.2 | 9.8 | 13.5 | 11.0 | 3.2 |
| | Liberated Silica Particle Ratio % | 2.8 | 0.3 | 6.8 | 11.2 | 8.2 | 0.1 |
| Results | Photoreceptor | ○ | ○ | ○ | X | ○ | ○ |
| (Filming) | Toner Regulating Blade | ○ | ○ | ○ | X | X | Δ |
| | Developing Roller | ○ | ○ | ○ | X | X | X |
| | No. of Printable Sheets | 10K | 10K | 10K | 1K or less | 3K | 5K |

*1available from Cabot Corporation
*2available from Mitsui Mining Company, Ltd.
○: no filming
Δ: slight filming
X: marked filming Since it can make heat to be hardly transferred to the mother particles 18 having a low melting point, the image forming apparatus 1 of this embodiment can provide excellent low-temperature fixing property while preventing the toner to be fused on the photoreceptor 2, the developing roller 16, and the toner regulating blade 17.

Actually, experiments for measurements of filming were conducted as for toners of Examples 1 through 3 of the present invention and also toners of Comparative Examples 1 through 3 for comparison to Examples 1 through 3. Toners used in the experiments, additive adhesion conditions (conditions for achieving adhesion of external additive particles to mother particles), and results of the experiments are shown in Table 1. The results were evaluated as follows.

Moreover, the liberated mother particle ratio (%) was 7.7% in Example 1, 5.2% in Example 2, 9.8% in Example 3, 13.5% in Comparative Example 1, 11.0% in Comparative Example 2, and 3.2% in Comparative Example 3. The liberated silica particle ratio was 2.8% in Example 1, 0.3% in Example 2, 6.8% in Example 3, 11.2% in Comparative Example 1, 8.2% in Comparative Example 2, and 0.1% in Comparative Example 3.

As apparent from Table 1, the toners T of Examples 1 through 3 had good results that no filming was observed on any of the photoreceptor 2, the developing roller 16, and the toner regulating blade 17 even after printing 10K sheets of paper. On the other hand, the toner of Comparative Example 1 had no-good results that filming was observed on the photoreceptor 2, the developing roller 16, and the toner regulating blade 17 before printing 1K sheets of paper. The toner of Comparative Example 2 had also no-good results that filming was observed on the toner regulating blade 17 and the developing roller 16 while no filming was observed on the photoreceptor 2 when 3K sheets of paper were printed. Moreover, the toner of Comparative Example 3 had no-good results that slight filming was observed on the toner regulating blade 17 and filming was observed on the developing roller 16 while no filming was observed on the photoreceptor 2 when 5k sheets of paper were printed.

Accordingly, by setting the liberated mother particle ratio to be 10% or less and setting the liberated silica particle ratio to be 0.2–10% or less, the occurrence of filming can be effectively prevented.

It should be noted that the present invention is not limited to the toner and the image forming apparatus of the aforementioned embodiment and may be applied to any toner T having at least mother particles and silica and any image forming apparatus which uses the toner T.

Now, another embodiment of the toner of the present invention will be described. The toner T of this embodiment includes mother particles 18, which is made of resin having a low softening point and thus is soft at ordinary temperature, and at least titanium oxide particles 19 as an external additive 19. The liberated mother particle ratio of liberated mother particles 18' without titanium oxide particle 19 adhering thereto is set to be 30% or less. The liberated mother particle ratio is a percentage of the amount of the liberated mother particles 18' relative to the entire amount of the toner. In addition, the liberated titanium oxide particle ratio of liberated titanium oxide particles 19 adhering to none of the mother particles 18 is set to be 5% or less. The liberated titanium oxide particle ratio is a percentage of the amount of the liberated titanium oxide particles 19 relative to the entire amount of the toner. Moreover, the titanium oxide particles 19 are surface treated with silane coupling agent so as to have hydrophobic property. The hydrophobic property improves the environmental stability, the fluidity, and the charging property of the toner like powder.

The flow softening point of the mother particles 18 of the toner T is preferably between 100° C. and 120° C. This is a reason that when the flow softening point of the mother particles 18 is lower than 100° C., the toner T gradually becomes easy to be fused onto the toner-contact members such as the developing roller 16, the toner regulating blade 17, and the photoreceptor 2. Though somewhat low flow softening point does not cause problems in practice, it is not preferable that the flow softening point is lower than that temperature. When the flow softening point of the mother particles 18 is higher than 120° C., the low-temperature fixing gradually becomes poor. Though somewhat high flow softening point does not cause problems in practice, it is not preferable that the flow softening point is higher than that temperature.

By the way, to obtain the aforementioned liberated mother particle ratio and the liberated titanium oxide particle ratio, it is necessary to measure the amount of liberated titanium oxide particles 19' adhering to none of the mother particles 18, the amount of liberated mother particles 18' with no titanium oxide particles adhering thereto, and the amount of mother particles 18 with some titanium oxide particles 19 adhering thereto. For this, it is necessary to analyze the state of adhesion between the mother particles 18 and the titanium oxide particles 19. The image forming apparatus 1 according to this embodiment employs, as the toner analyzing method, the particle analyzing method similarly to the toner T of the aforementioned embodiment.

In the present invention, a distribution map indicating equivalent particle diameters of the toner particles with regard to titanium oxide ($TiO_2$) similar to the distribution map shown in FIG. 5 is obtained, and the liberated mother particle ratio and the liberated titanium oxide particle ratio are obtained from the state of adhesion of titanium oxide particles relative to the mother particles (C) of the toner T analyzed by using the distribution map for this toner.

Similarly to the toner T of the aforementioned embodiment, the toner T of this embodiment may be of a negative polarity or of a positive polarity. The mother particles comprises at least a coloring agent, an charge controlling agent, and other resin. Moreover, a dispersant, a releasing agent (WAX), a magnetic material, and other additives may be suitably added.

The mother particles 18, the coloring agent, the charge controlling agent, the releasing agent, the dispersant, the additives, and magnetic material used in the toner T of this embodiment may be the same as the mother particle material, the coloring agent, the charge controlling agent, the releasing agent, the dispersant, the additives, and magnetic material used in the toner T of the aforementioned embodiment.

The foregoing materials are formed into the mother particles 18 by the same method as used for forming the mother particles 18 of the toner T of the aforementioned embodiment.

The external additive 19 may be titanium oxide only or may be titanium oxide mixed with, for example, silica, or one or more selected from a group consisting of inorganic fine particles, for example, fine particles of metal oxide, fine particles of nitride, fine particles of carbide, fine particles of metallic salt, and composites thereof, and organic fine particles similarly to the toner T of the aforementioned embodiment. As its surface treatment material, the same material as used for the toner of the aforementioned embodiment may be employed. Also similar to the aforementioned embodiment, it is preferable that the particle diameter of the external additives 19 is 0.001 μm to 1 μm.

The mother particles 18 and the external additives 19 are mixed in a dry state so as to adhere to one another by using a mixer in the same manner as the toner T of the aforementioned embodiment.

According to the toner T of this embodiment as mentioned above, the liberated mother particle ratio is set to be 30% or less and the liberated titanium oxide particle ratio is set to be 5% or less, whereby the amount of liberated mother particles 18' and the amount of liberated titanium oxide particles 19' can be suitably set relative to the entire amount of the toner T. Therefore, the amount of the titanium oxide particles 19 adhering to the mother particles 18 is also suitably set so that excess charge of the liberated mother particles 18' can be prevented and the charging property of the toner T can be stabilized, thereby preventing the toner scattering and performing excellent development. As a result, high-quality images can be obtained.

Further, since the silica particles are surface treated with silane coupling agent, the toner T has hydrophobic property. The hydrophobic property improves the fluidity of the toner like powder, thereby further effectively preventing the occurrence of filming of the toner T.

According to the image forming apparatus 1 of the present invention, by using the aforementioned toner T, the durability of the photoreceptor 2, the developing roller 16, and the toner regulating blade 17 can be improved and high quality images can be obtained.

Actually, experiments for measurements of the toner charge were conducted as for toners of Examples 4 and 5 of the present invention and also toners of Comparative Examples 4 and 5 for comparison to Examples 4 and 5. Toners used in the experiments, additive adhesion condition, and results of the experiments are shown in Table 2. The results were evaluated according to the toner charge and the toner fogging after printing 1K (1K=1000) sheets of paper.

TABLE 2

| | | Example 4 | Example 5 | Comparative Example 4 | Comparative Example 5 |
|---|---|---|---|---|---|
| Mother Particles | | Pulverized Toners | ← | ← | ← |
| Silica | | TG810G*1 | ← | ← | ← |
| Titanium Oxide | | NKT90*2 | ← | ← | ← |
| Additive | Mixer | Henshel 20C*3 | ← | ← | ← |
| Adhesion | Revolution Speed | 2850 rpm | ← | ← | ← |
| Condition | Adding Amount | 0.5 parts by weight | ← | ← | ← |
| | Time Period | 4 min | 3 min | 1 min | 2 min |
| | Liberated Mother Particle Ratio % | 24.6 | 27.2 | 35.2 | 29.3 |
| | Liberated Titanium Oxide Particle Ratio % | 1.0 | 4.2 | 7.6 | 5.6 |
| Initial Toner Charge μc/g | | 15.2 | 16.3 | 16.3 | 14.9 |
| Results | Toner Charge after printing 1K μc/g | 16.1 | 15.6 | 10.9 | 10.6 |
| | Toner Fogging after printing 1K g/1K | 8.2 | 9.0 | 15.3 | 13.2 |

*1available from Cabot Corporation
*2available from Nippon Aerosil Co., Ltd
*3available from Mitsui Mining Co., Ltd.

As shown in Table 2, the toners of Examples 4 and 5 belonging to the present invention and the toners of Comparative Examples 4 and 5 not belonging to the present invention were pulverized toners of which used mother particles 18 were prepared by the pulverization, and silica and titanium oxide were used as the external additives 19. In this case, the silica was TG810G (available from Cabot Corporation) and the titanium oxide was NKT90 (available from Nippon Aerosil Company, Ltd.). The examples were prepared under the same adhesion condition that a mixer used for adhesion of the titanium oxide particles to the mother particles 18 was Henshel 20C (manufactured by Mitsui Mining Company, Ltd.), the revolution speed of the mixer was 2850 rpm., and the adding amount was 0.5 parts by weight.

The time period taken for the additive adhesion was four minutes in Example 4, three minutes in Example 5, one minute in Comparative Example 4, and two minutes in Comparative Example 5.

Moreover, the liberated mother particle ratio (%) was 24.6% in Example 4, 27.2% in Example 5, 35.2% in Comparative Example 4, and 29.3% in Comparative Example 5. The liberated titanium oxide particle ratio was 1.0% in Example 4, 4.2% in Example 5, 7.6% in Comparative Example 4, and 5.6% in Comparative Example 5. The initial toner charge was 15.2 μc/g in Example 4, 16.3 μc/g in Example 5, 16.3 μc/g in Comparative Example 4, and 14.9 μc/g in Comparative Example 5.

As apparent from Table 2, the toners T of Example 4 had a good result that the toner charge after printing 1K sheets of paper was 16.1 μc/g that was slightly larger than the initial toner charge and the difference therebetween was little. This means that the toner has stable charging property. The toner T of Example 5 had a good result that the toner charge after printing 1K sheets of paper was 15.6 μc/g that was slightly smaller than the initial toner charge and the difference therebetween was little. This also means that the toner has stable charging property.

To the contrary, the toner T of Comparative Example 4 had a no-good result that the toner charge after printing 1K sheets of paper was 10.9 μc/g that was significantly smaller than the initial toner charge and the difference therebetween was marked. This means that the toner has unstable charging property. The toner T of Comparative Example 5 had a no-good result that the toner charge after printing 1K sheets of paper was 10.6 μc/g that was significantly smaller than the initial toner charge and the difference therebetween was marked. This means that the toner has unstable charging property.

Moreover, the toner T of Example 4 had also a good result that the toner fogging after printing 1K sheets of paper was 8.2 g/1K that was relatively small. The toner T of Example 5 had also a good result that the toner fogging after printing 1K sheets of paper was 9.0 g/1K that was similarly relatively small.

To the contrary, the toner T of Comparative Example 4 had also a no-good result that the toner fogging after printing 1K sheets of paper was 15.3 g/1K that was relatively large. The toner T of Comparative Example 5 had also a no-good result that the toner fogging after printing 1K sheets of paper was 13.2 g/1K that was relatively large.

Accordingly, by setting the liberated mother particle ratio to be 30% or less and setting the liberated silica particle ratio to be 5% or less, the stable charging property can be obtained.

It should be noted that the present invention is not limited to the toner and the image forming apparatus of the aforementioned embodiment and may be applied to any toner T having at least mother particles and titanium oxide and any image forming apparatus which uses the toner T.

Now, further another embodiment of the toner T of the present invention will be described. The toner T of this embodiment includes mother particles 18, which is made of resin having a low softening point and thus is soft at ordinary temperature, and at least alumina particles 19 as an external additive 19. The liberated mother particle ratio of liberated mother particles 18' without alumina particle 19 adhering thereto is set to be 30% or less. The liberated mother particle ratio is a percentage of the amount of the liberated mother particles 18' relative to the entire amount of the toner. In addition, the liberated alumina particle ratio of liberated alumina particles 19 adhering to none of the mother particles 18 is set to be 0.2–5%. The liberated alumina particle ratio is a percentage of the amount of the liberated alumina particles 19 relative to the entire amount of the toner.

The flow softening point of the mother particles 18 of the toner T is preferably between 100° C. and 120° C. This is a reason that when the flow softening point of the mother particles 18 is lower than 100° C., the toner T gradually becomes easy to be fused onto the toner-contact members such as the developing roller 16, the toner regulating blade 17, and the photoreceptor 2. Though somewhat low flow softening point does not cause problems in practice, it is not preferable that the flow softening point is lower than that temperature. When the flow softening point of the mother particles 18 is higher than 120° C., the low-temperature fixing gradually becomes poor. Though somewhat high flow softening point does not cause problems in practice, it is not preferable that the flow softening point is higher than that temperature.

By the way, to obtain the aforementioned liberated mother particle ratio and the liberated alumina particle ratio, it is necessary to measure the amount of liberated alumina particles 19' adhering to none of the mother particles 18, the amount of liberated mother particles 18' with no alumina particles 19 adhering thereto, and the amount of mother particles 18 with some alumina particles 19 adhering thereto. For this, it is necessary to analyze the state of adhesion between the mother particles 18 and the alumina particles 19. The image forming apparatus 1 according to this embodiment employs, as the toner analyzing method, the particle analyzing method similarly to the toner T of the aforementioned embodiment.

In the present invention, a distribution map indicating equivalent particle diameters of the toner particles with regard to alumina similar to the distribution map shown in FIG. 5 is obtained, and the liberated mother particle ratio and the liberated alumina particle ratio are obtained from the state of adhesion of alumina particles relative to the mother particles (C) of the toner T analyzed by using the distribution map for this toner.

Similarly to the toner T of the aforementioned embodiment, the toner T of this embodiment may be of a negative polarity or of a positive polarity. The mother particles 18 comprises at least a coloring agent, an charge controlling agent, and other resin. Moreover, a dispersant, a releasing agent (WAX), a magnetic material, and other additives may be suitably added.

The mother particles 18, the coloring agent, the charge controlling agent, the releasing agent, the dispersant, the additives, and magnetic material used in the toner T of this embodiment may be the same as the mother particle material, the coloring agent, the charge controlling agent, the releasing agent, the dispersant, the additives, and magnetic material used in the toner T of the aforementioned embodiment.

The foregoing materials are formed into the mother particles 18 by the same method as used for forming the mother particles 18 of the toner T of the aforementioned embodiment.

The external additive 19 may be alumina only or may be alumina mixed with, for example, silica, titanium oxide, or one or more selected from a group consisting of inorganic fine particles, for example, fine particles of metal oxide, fine particles of nitride, fine particles of carbide, fine particles of metallic salt, and composites thereof, and organic fine particles similarly to the toner T of the aforementioned embodiment. As its surface treatment material, the same material as used for the toner of the aforementioned embodiment may be employed. Also similar to the aforementioned embodiment, it is preferable that the particle diameter of the external additives 19 is 0.001 μm to 1 μm.

The mother particles 18 and the external additives 19 are mixed in a dry state so as to adhere to one another by using a mixer in the same manner as the toner T of the aforementioned embodiment.

According to the toner T of this embodiment as mentioned above, the liberated mother particle ratio is set to be 30% or less and the liberated alumina particle ratio is set to be 0.2–5%, whereby the amount of liberated mother particles 18' and the amount of liberated alumina particles 19' can be suitably set relative to the entire amount of the toner T. Therefore, the amount of the alumina particles 19 as an external additive adhering to the mother particles 18 is also suitably set, thereby stabilizing the charging property of the toner and effectively cleaning the photoreceptor 2.

Since the amount of liberated mother particles 18' and the amount of liberated alumina particles 19' can be suitably set, the amount of the alumina particles 19 adhering to the mother particles 18 is also suitably set, thereby reducing the possibility that the liberated mother particles 18', the liberated alumina particles 19', and the mother particles 18 with alumina particles 19 therein [particularly, resin and releasing agent (WAX) having a low melting point] will be fused on the photoreceptor 2, the developing roller 16, and/or the toner regulating blade 17, and thus effectively preventing the filming of toner. Therefore, according to the toner T, the durability of the photoreceptor 2, the developing roller 16, and the toner regulating blade 17 can be improved and the image quality can be also improved.

On the other hand, in the image forming apparatus 1, the latent image carrier can be effectively cleaned by using the toner of the present invention.

By using the toner T, the durability of the photoreceptor 2, the developing roller 16, and the toner regulating blade 17 can be improved and the image quality can be also improved.

Actually, experiments for measurements of the toner charge were conducted as for toners of Examples 6 through 8 of the present invention and also toners of Comparative Examples 6 through 8 for comparison to Examples 6 through 8. Toners used in the experiments, additive adhesion conditions, and results of the experiments are shown in Table 3. The results were evaluated according to the toner charge, the toner fogging, and the occurrence of filming on the photoreceptor 2 after printing 1K (1K=1000) sheets of paper.

As shown in Table 3, the toners of Examples 6 through 8 belonging to the present invention and the toners of Comparative Examples 6 through 8 not belonging to the present invention were pulverized toners of which used mother particles 18 were prepared by the pulverization, and silica and alumina were used as the external additives 19. In this case, the silica was TG810G (available from Cabot Corporation) and the alumina was Aluminium Oxide C (available from Nippon Aerosil Company, Ltd.). The examples were prepared under the same adhesion condition that a mixer used for adhesion of the silica particles and the alumina particles to the mother particles 18 was Henshel 20C (manufactured by Mitsui Mining Company, Ltd.), the revolution speed of the mixer was 2850 rpm., and the adding amount was 0.5 parts by weight.

The time period taken for the additive adhesion was four minutes in Example 6, six minutes in Example 7, and three minutes in Example 8, while the time period was one minute in Comparative Example 6, two minutes in Comparative Example 7, and eight minutes in Comparative Example 8.

TABLE 3

| | | Example 6 | Example 7 | Example 8 | Comparative Example 6 | Comparative Example 7 | Comparative Example 8 |
|---|---|---|---|---|---|---|---|
| | | | | ← | ← | ← | ← |
| Alumina | | Aluminium Oxide C*2 | ← | ← | ← | ← | ← |
| Additive | Mixer | Henshel 20C*3 | ← | ← | ← | ← | ← |
| Adhesion | Revolution Speed | 2850 rpm | ← | ← | ← | ← | ← |
| Condition | Adding Amount. | 0.5 parts by weight | ← | ← | ← | ← | ← |
| | Time Period | 4 min | 6 min | 3 min | 1 min | 2 min | 8 min |
| | Liberated Mother Particle Ratio % | 23.5 | 18.5 | 28.3 | 40.6 | 32.1 | 12.3 |
| | Liberated Alumina Particle Ratio % | 3.2 | 0.5 | 4.2 | 8.2 | 4.8 | 0.1 |
| Initial Toner Charge μc/g | | 14.3 | 15.3 | 14.8 | 13.9 | 15.1 | 13.5 |
| Results | Toner Charge after printing 1K μc/g | 14.1 | 14.6 | 14.8 | 9.2 | 11.1 | 12.8 |
| | Toner Fogging after printing 1K g/1K | 6.5 | 5.4 | 7.0 | 16.8 | 8.2 | 6.8 |
| | Filming on Photoreceptor | ○ | ○ | ○ | X | ○ | ○ |
| | Poor Cleaning | ○ | ○ | ○ | ○ | ○ | X |

*1available from Cabot Corporation
*2available from Nippon Aerosil Co., Ltd
*3available from Mitsui Mining Co., Ltd.
○: not occurred
X: occurred Moreover, the liberated mother particle ratio (%) was 23.5% in Example 6, 18.5% in Example 7, and 28.3% in Example 8, while the ratio was 40.6% in Comparative Example 6, 32.1% in Comparative Example 7 and 12.3% in Comparative Example 8.

The liberated alumina particle ratio was 3.2% in Example 6, 0.5% in Example 7, and 4.2% in Example 8, while the ratio was 8.2% in Comparative Example 6, 4.8% in Comparative Example 7, and 0.1% in Comparative Example 8.

The initial toner charge was 14.3 μc/g in Example 6, 15.3 μc/g in Example 7, 14.8 μc/g in Example 8, while the initial toner charge was 13.9 μc/g in Comparative Example 6, 15.1 μc/g in Comparative Example 7, and 13.4 μc/g in Comparative Example 8.

As apparent from Table 3, the toners T of Example 6 had a good result that the toner charge after printing 1K sheets of paper was 14.1 μc/g that was slightly smaller than the initial toner charge and the difference therebetween was little. This means that the toner has stable charging property. The toners T of Example 7 had a good result that the toner charge after printing 1K sheets of paper was 14.6 μc/g that was slightly smaller than the initial toner charge and the difference therebetween was little. This means that the toner has stable charging property. The toner T of Example 8 had a good result that the toner charge after printing 1K sheets of paper was 14.8 μc/g that is the same as the initial toner charge and there was no difference therebetween. This also means that the toner has stable charging property.

To the contrary, the toner of Comparative Example 6 had a no-good result that the toner charge after printing 1K sheets of paper was 9.2 μc/g that was significantly smaller than the initial toner charge and the difference therebetween was relatively large. This means that the toner has unstable charging property. The toner of Comparative Example 7 had a no-good result that the toner charge after printing 1K sheets of paper was 11.1 μc/g that was significantly smaller than the initial toner charge and the difference therebetween was marked. This means that the toner has unstable charging property. However, the toner of Comparative Example 8 had a good result that the toner charge after printing 1K sheets of paper was 12.8 μc/g that was slightly smaller than the initial toner charge and the difference therebetween was almost the same as that of Example 7. This means that the toner has unstable charging property.

Moreover, the toner T of Example 6 had also a good result that the toner fogging after printing 1K sheets of paper was 6.5 g/1K that was relatively small. The toner T of Example 7 had also a good result that the toner fogging after printing 1K sheets of paper was 5.4 g/1K that was relatively small. Further, the toner T of Example 8 had also a good result that the toner fogging after printing 1K sheets of paper was 7.0 g/1K that was similarly relatively small.

To the contrary, the toner T of Comparative Example 6 had also a no-good result that the toner fogging after printing 1K sheets of paper was 16.8 g/1K that was relatively large. The toner T of Comparative Example 7 has a good result that the toner fogging after printing 1K sheets of paper was 8.2 g/1K that was similarly relatively small. The toner T of Comparative Example 8 has a good result that the toner fogging after printing 1K sheets of paper was 6.8 g/1K that was relatively small.

Further, the toners T of Examples 6 through 8 and the toners of Comparative Examples 7 and 8 had good results that no filming is observed on the photoreceptor 2 after printing 1K sheets of paper. To the contrary, the toner T of Comparative Example 6 had a no-good result that filming is observed on the photoreceptor 2 after printing 1K sheets of paper.

Furthermore, the toners T of Examples 6 through 8 and the toners of Comparative Examples 6 and 7 had good results that no cleaning defect is observed after printing 1K sheets of paper. To the contrary, the toner T of Comparative Example 8 had a no-good result that cleaning defect is observed after printing 1K sheets of paper.

Accordingly, by setting the liberated mother particle ratio to be 30% or less and setting the liberated alumina particle ratio to be 0.2–5%, the toner can have stable charging property and can prevent fogging. In addition, the toner T allows excellent cleaning of the photoreceptor 2.

It should be noted that the present invention is not limited to the toner and the image forming apparatus of the aforementioned embodiment and may be applied to any toner having at least mother particles and alumina and any image forming apparatus which uses the toner T.

Now, still another embodiment of the toner T of the present invention will be described. The toner T of this embodiment includes a plurality of mother particles 18, which is made of resin having a low softening point and thus is soft at ordinary temperature, and a plurality of external additives 19 such as silica for coating the mother particles 18. In the toner T in which the roundness of the mother particles is 0.95 or less, the liberated additive particle ratio of liberated external additive particles 19' adhering to none of the mother particles 18 is set to be 0.2–5%. Too low roundness may not ensure the aforementioned functions and the effects as will be described so that the roundness of the mother particles is preferably between 0.88 and 0.95.

Roundness is obtained by the following equation:

Roundness=(Circumference of a circle having the same area as the projected area of a particle)/{Length of contour of an projected image of the particle (Circumference)}.

The roundness of each mother particle 18 can be measured by, for example, a sheath flow particle image analyzer (FPIA-2100; manufactured by Sysmex Corporation). In this sheath flow particle image analyzer, toner particles T are introduced to pass through a flat sheath flow cell so that the toner particles are formed in a sample flat flow by application of sheath fluid. The sample flow is subjected to electronic flash. The particles in the sample flow during passing through the flow cell are photographed as a static image in a state where they will always be in focus through an objective lens by a CCD camera. The photographed particle image is analyzed in real time to measure the projected area and the length of contour of each individual particle. From the projected area and the length of contour, the round equivalent diameter and roundness of each individual particle can be determined.

Though the aforementioned sheath flow particle image analyzer is used for obtaining the roundness of the mother particles 18 in this embodiment, another method for obtaining the roundness may be employed for obtaining the roundness of the mother particles, besides the method using the aforementioned sheath flow particle image analyzer. However, the method using the sheath flow particle image analyzer is preferable because highly accurate particle roundness can be obtained easily.

To obtain the liberation ratio in the toner, the particle analyzing method is employed in the same manner as the aforementioned embodiment.

In the present invention, the liberated additive particle ratio is obtained from the state of adhesion of external additive particles 19 relative to the mother particles 18 of the toner T analyzed by using a distribution map indicating equivalent particle diameters as shown in FIG. 5.

Similarly to the toner T of the aforementioned embodiment, the toner T of this embodiment may be of a negative polarity or of a positive polarity. The mother particles 18 comprises at least a coloring agent, an charge controlling agent, and other resin. Moreover, a dispersant, a releasing agent (WAX), a magnetic material, and other additives may be suitably added.

The mother particles 18, the coloring agent, the charge controlling agent, the releasing agent, the dispersant, the additives, and magnetic material used in the toner T of this embodiment may be the same as the mother particle material, the coloring agent, the charge controlling agent, the releasing agent, the dispersant, the additives, and magnetic material used in the toner T of the aforementioned embodiment.

The foregoing materials are formed into the mother particles 18 by the same method as used for forming the mother particles 18 of the toner T of the aforementioned embodiment.

The external additive 19 may be silica, titanium oxide, alumina, in addition, one or more selected from a group consisting of inorganic fine particles, for example, fine particles of metal oxide, fine particles of nitride, fine particles of carbide, fine particles of metallic salt, and composites thereof, and organic fine particles similarly to the toner T of the aforementioned embodiment. These may be used singly or in mixed state. As its surface treatment material, the same material as used for the toner of the aforementioned embodiment may be employed. Also similar to the aforementioned embodiment, it is preferable that the particle diameter of the external additives 19 is 0.001 μm to 1 μm.

The mother particles 18 and the external additives 19 are mixed in a dry state so as to adhere to one another by using a mixer in the same manner as the toner T of the aforementioned embodiment.

According to the toner T of this embodiment as mentioned above, the roundness of the mother particles is 0.95 or less and the liberated additive particle ratio is set to be 0.2–5%, whereby the mother particles 18 are not too spherical and the amount of liberated external additive particles 19' can be suitably set relative to the entire amount of the toner T. Accordingly, in the cleaning of the toner-contact members such as the photoreceptor 2 and the intermediate transfer belt 7*a* by the cleaning blade 11 of the cleaning device, mother particles 18 of residual toner T after transferred hardly pass below the cleaning blade 11 so that the residual toner particles remaining on the toner-contact members such as the photoreceptor 2 and the intermediate transfer belt 7*a* can securely removed and collected by the cleaning blade. Therefore, the occurrence of filming on the toner-contact members can be prevented, thereby improving the durability of the toner-contact members which are cleaned by the cleaning blade 11.

Since the amount of liberated external additive particles 19' is suitably set relative to the entire amount of the toner T, the mother particles 18 can be effectively coated with the external additive particles 19, thereby preventing the occurrence of filming on the toner-contact members due to fusion of mother particles 18. This also can improve the durability of the toner-contact members. In addition, the inside of the developing devices 3, 4, 5, 6 are hardly soiled by liberated external additive particles 19'. Particularly, the charging members, such as the developing roller 16 and the toner regulating blade 17, for charging the toner T are prevented from being coated with external particles 19, thereby facilitating charging of the toner T and thus improving the charging property of the toner T.

According to the toner T of this embodiment, the durability of the toner contact members such as the photoreceptor 2, the developing roller 16, the toner regulating blade 17, and the intermediate transfer belt 7*a* can be improved and high-quality images can be obtained.

In addition, the mother particles 18 are effectively coated with external additive particles 19, thereby preventing a large quantity of heat for heat fixing from being consumed by the external additive particles 19. Therefore, heat can be effectively transferred to the mother particles 18, so that the low-temperature fixing property can be improved and the releasing agent can be suitably eluted from the toner T, thereby improving the fixing property.

In the image forming apparatus 1 of this embodiment by using the toner T, the durability of the toner contact members such as the photoreceptor 2, the developing roller 16, the toner regulating blade 17, and the intermediate transfer belt 7*a* can be improved and high-quality images can be obtained.

Actually, experiments for measurements of filming of toner on the photoreceptor 2, the developing roller 16, and the toner regulating blade 17 were conducted as for toners of Examples 9 through 11 of the present invention and also toners of Comparative Examples 9 and 10 for comparison to Examples 9 through 11. Toners used in the experiments, additive adhesion condition, and results of the experiments are shown in Table 4. The results were evaluated as follows. When there is no filming of toner T on any of the photoreceptor 2, the developing roller 16, and the toner regulating blade 17 even after printing 10K (1K=1000) sheets of paper, "Good" was given for evaluation. When there is any filming of toner T on either one of the photoreceptor 2, the developing roller 16, and the toner regulating blade 17 before printed 10K sheets of paper, "No Good" was given for evaluation.

As shown in Table 4, the toners of Examples 9 through 11 belonging to the present invention and the toners of Comparative Examples 9 and 10 not belonging to the present invention were pulverized toners of which used mother particles 18 were prepared by the pulverization, and silica ($SiO_2$) was used as the external additives. In this case, the silica was TG810G (available from Cabot Corporation). The examples were prepared under the same adhesion condition that a mixer used for adhesion of the silica particles to the mother particles 18 was Henshel 20C (manufactured by Mitsui Mining Company, Ltd.), the revolution speed of the mixer was 2850 rpm., and the adding amount was 1.0 parts by weight.

TABLE 4

| | | Example 9 | Example 10 | Example 11 | Comparative Example 9 | Comparative Example 10 |
|---|---|---|---|---|---|---|
| Mother Particles | | Pulverized Toners | ← | ← | ← | ← |
| Silica (External Additive) | | TG810G*1 | ← | ← | ← | ← |
| Additive | Mixer | Henshel 20C*2 | ← | ← | ← | ← |
| Adhesion | Revolution Speed | 2850 rpm | ← | ← | ← | ← |
| Condition | Adding Amount | 1.0 part by weight | ← | ← | ← | ← |
| | Time Period | 4 min | 6 min | 3 min | 2 min | 10 min |
| | Roundness of Mother Particle | 0.92 | 0.91 | 0.92 | 0.92 | 0.91 |
| | Liberated Silica Particle Ratio % | 2.8 | 0.3 | 4.9 | 8.2 | 0.1 |
| Results | Photoreceptor | ○ | ○ | ○ | X | ○ |
| (Filming) | Toner Regulating Blade | ○ | ○ | ○ | X | X |
| | Developing Roller | ○ | ○ | ○ | Δ | X |
| | No. of Printable Sheets | 10K | 10K | 10K | 1K or less | 3K |

*1available from Cabot Corporation
*2available from Mitsui Mining Company, Ltd.
○: no filming
Δ: slight filming
X: marked filming The time period taken for the additive adhesion was four minutes in Example 9, six minutes in Example 10, three minutes in Example 11, two minutes in Comparative Example 9, and ten minutes in Comparative Example 10.

Moreover, the roundness of the mother particles was 0.92 in Example 9, 0.91 in Example 10, 0.92 in Example 11, 0.92 in Comparative Example 9, and 0.91 in Comparative Example 10. The liberated silica particle ratio was 2.8% in Example 9, 0.3% in Example 10, 4.9% in Example 11, 8.2% in Comparative Example 9, and 0.1% in Comparative Example 10.

As apparent from Table 4, the toners T of Examples 9 through 11 had good results that no filming was observed on any of the photoreceptor 2, the developing roller 16, and the toner regulating blade 17 even after printing 10K sheets of paper. On the other hand, the toner of Comparative Example 9 had no-good results that filming was observed on the photoreceptor 2 and the toner regulating blade 17 and slight filming was observed on the developing roller 16 before printed 1K sheets of paper. The toner of Comparative Example 10 had also no-good results that filming was observed on the toner regulating blade 17 and the developing roller 16 while no filming was observed on the photoreceptor 2 when 3K sheets of paper were printed.

Accordingly, by setting the roundness of mother particles to be 0.95 or less and setting the liberated silica particle ratio to be 0.2–5%, the occurrence of filming can be effectively prevented.

Though liberated silica particle ratio is shown in Table 4 as the liberated additive particle ratio, the present invention may be applied to other liberated additive particle ratio. However, the liberated silica particle ratio is preferable to be adapted as the liberated additive particle ratio of the present invention because the aforementioned works and effects can be securely obtained.

It should be noted that the present invention is not limited to the toner and the image forming apparatus of the aforementioned embodiment and may be applied to any toner having at least mother particles and external additive particles such as silica particles and any image forming apparatus which uses the toner T.

Now, yet another embodiment of the toner T of the present invention will be described. The toner T of this embodiment includes a plurality of mother particles 18, which is made of resin having a low softening point and thus is soft at ordinary temperature, and a plurality of external additives 19 such as silica for coating the mother particles 18. The toner T is a polymerized toner which is prepared by polymerization or a pulverized toner which is prepared by a pulverization and are rounded by heat treatment in which the roundness of the mother particles is 0.95 or more. In this toner T, the liberated additive particle ratio of liberated external additive particles 19' adhering to none of the mother particles 18 is set to be 3–10%. Too high roundness may not ensure the aforementioned functions and the effects as will be described later because the mother particles are too spherical so that the roundness of the mother particles is preferably between 0.96 and 0.98.

The roundness of each mother particle 18 of the toner T can be measured in the same manner as the aforementioned embodiment. To obtain the liberation ratio in the toner, the particle analyzing method is employed in the same manner as the aforementioned embodiment.

In the present invention, the liberated additive particle ratios such as the liberated silica particle ratio are obtained from the state of adhesion of external additive particles 19 relative to the mother particles 18 of the toner T analyzed by using a distribution map indicating equivalent particle diameters as shown in FIG. 5.

Similarly to the toner T of the aforementioned embodiment, the toner T of this embodiment may be of a negative polarity or of a positive polarity. The mother particles 18 comprises at least a coloring agent, an charge controlling agent, and other resin. Moreover, a dispersant, a releasing agent (WAX), a magnetic material, and other additives may be suitably added.

The mother particles 18, the coloring agent, the charge controlling agent, the releasing agent, the dispersant, the additives, and magnetic material used in the toner T of this embodiment may be the same as the mother particle material, the coloring agent, the charge controlling agent, the releasing agent, the dispersant, the additives, and magnetic material used in the toner T of the aforementioned embodiment.

The foregoing materials are formed into the mother particles 18 by the same method as used for forming the mother particles 18 of the toner T of the aforementioned embodiment.

The external additive 19 may be silica, titanium oxide, alumina, in addition, one or more selected from a group consisting of inorganic fine particles, for example, fine particles of metal oxide, fine particles of nitride, fine particles of carbide, fine particles of metallic salt, and composites thereof, and organic fine particles similarly to the toner T of the aforementioned embodiment. These may be used singly or in mixed state. As its surface treatment material, the same material as used for the toner T of the aforementioned embodiment may be employed. Also similar to the aforementioned embodiment, it is preferable that the particle diameter of the external additives 19 is 0.001 μm to 1 μm.

The mother particles 18 and the external additives 19 are mixed in a dry state so as to adhere to one another by using a mixer in the same manner as the toner T of the aforementioned embodiment.

According to the toner T of this embodiment as mentioned above, the liberated additive particle ratio is set to be 3–10% in the toner of which the roundness of the mother particles is 0.95 or more. Therefore, in a toner of which mother particles are nearly equal to the perfect sphere as a polymerized toner which is prepared by polymerization or a pulverized toner which is prepared by a pulverization and are rounded by heat treatment, the amount of liberated external additive particles 19' can be suitably set relative to the entire amount of the toner T. Accordingly, even in case of a toner with such mother particles which are nearly equal to the perfect sphere, enough cleaning effect for the toner-contact members such as the photoreceptor can be obtained because the liberated external additive particles work as a trigger, thereby improving the cleaning property.

Since the amount of liberated external additive particles 19' is suitably set relative to the entire amount of the toner T, the mother particles 18 can be effectively coated with the external additive particles 19 so that the mother particles 18 are hardly fused on the toner-contact members, thereby preventing the occurrence of filming on the toner-contact members. According to the toner T of this embodiment, the durability of the toner contact members such as the photoreceptor 2, the developing roller 16, the toner regulating blade 17, and the intermediate transfer belt 7*a* can be improved and high-quality images can be obtained.

In the image forming apparatus 1 of this embodiment by using the toner T, the durability of the toner contact members such as the photoreceptor 2, the developing roller 16, the toner regulating blade 17, and the intermediate transfer belt 7*a* can be improved and high-quality images can be obtained.

Actually, experiments for measurements of filming of toner on and cleaning for the photoreceptor 2, the developing roller 16, and the toner regulating blade 17 were conducted as for toners of Examples 12 through 14 of the present invention and also toners of Comparative Examples 11 and 12 for comparison to Examples 12 through 14. Toners used in the experiments, additive adhesion condition, and results of the experiments are shown in Table 5. The results were evaluated as follows. When there is no filming of toner T on any of the photoreceptor 2, the developing roller 16, and the toner regulating blade 17 even after printing 10K (1K=1000) sheets of paper, "Good" was given for evaluation. When there is any filming of toner T on either one of the photoreceptor 2, the developing roller 16, and the toner regulating blade 17 before printed 10K sheets of paper, "No Good" was given for evaluation.

As shown in Table 5, the toners of Examples 12 and 13 belonging to the present invention and the toners of Comparative Example 12 not belonging to the present invention were pulverized toners of which used mother particles 18 were prepared by the pulverization and processed by rounding treatment. The toners of Example 14 belonging to the present invention and the toners of Comparative Example 12 not belonging to the present invention were polymerized toners of which used mother particles 18 were prepared by polymerization.

In every toner, silica ($SiO_2$) was used as the external additive. In this case, the silica was TG810G (available from Cabot Corporation). The examples were prepared under the same adhesion condition that a mixer used for adhesion of the silica particles to the mother particles 18 was Henshel 20C (manufactured by Mitsui Mining Company, Ltd.), the revolution speed of the mixer was 2850 rpm., and the adding amount was 1.0 parts by weight.

TABLE 5

| | | Example 12 | Example 13 | Example 14 | Comparative Example 11 | Comparative Example 12 |
|---|---|---|---|---|---|---|
| Mother Particles | | Pulverized Rounded Toner | ← | Polymerized Toner | ← | Pulverized Rounded Toner |
| Silica (External Additive) | | TG810G*1 | ← | ← | ← | ← |
| Additive | Mixer | Henshel 20C*2 | ← | ← | ← | ← |
| Adhesion | Revolution Speed | 2850 rpm | ← | ← | ← | ← |
| Condition | Adding Amount | 1.0 part by weight | ← | ← | ← | ← |
| | Time Period | 3 min | 5 min | 2 min | 6 min | 1 min |
| | Roundness of Mother Particle | 0.97 | 0.96 | 0.97 | 0.96 | 0.97 |
| | Liberated Silica Particle Ratio % | 5.2 | 3.2 | 9.5 | 2.1 | 11.2 |
| Results | Poor Cleaning | ○ | ○ | ○ | X | ○ |
| | Filming on Photoreceptor | ○ | ○ | ○ | ○ | X |
| | Filming on Toner Regulating Blade | ○ | ○ | ○ | ○ | X |
| | Filming on Developing Roller | ○ | ○ | ○ | ○ | X |
| | No. of Printable Sheets | 10K | 10K | 10K | 2K | 3K |

*1available from Cabot Corporation
*2available from Mitsui Mining Company, Ltd.
○: not occurred
X: occurred The time period taken for the additive adhesion was three minutes in Example 12, five minutes in Example 13, two minutes in Example 14, six minutes in Comparative Example 11, and one minute in Comparative Example 12.

Moreover, the roundness of the mother particles was 0.97 in Example 12, 0.96 in Example 13, 0.97 in Example 14, 0.96 in Comparative Example 11, and 0.97 in Comparative Example 12. The liberated silica particle ratio was 5.2% in Example 12, 3.2% in Example 13, 9.5% in Example 14, 2.1% in Comparative Example 11, and 11.2% in Comparative Example 12.

As apparent from Table 5, the toners T of Examples 12 through 14 had good results that the cleaning was satisfactory and no filming was observed on any of the photoreceptor 2, the developing roller 16, and the toner regulating blade 17 even after printing 10K sheets of paper. On the other hand, the toner T of Comparative Example 11 had generally no-good results that poor cleaning was observed when 2k sheets of paper were printed while no filming was observed on any of the photoreceptor 2, the toner regulating blade 17, and the developing roller 16. The toner T of Comparative Example 12 had also generally no-good results that filming was observed on the photoreceptor 2, the toner regulating blade 17, and the developing roller 16 when 3K sheets of paper were printed while the cleaning effect was not poor.

Accordingly, by setting the roundness of mother particles to be 0.95 or more and setting the liberated silica particle ratio to be 3–10%, the cleaning property can be improved and the occurrence of filming on the toner-contact members can be effectively prevented even with particles nearly equal to the perfect sphere.

Though liberated silica particle ratio is shown in Table 5 as the liberated additive particle ratio, the present invention may be applied to other liberated additive particle ratio. However, the liberated silica particle ratio is preferable to be adapted as the liberated additive particle ratio of the present invention because the aforementioned works and effects can be securely obtained.

It should be noted that the present invention is not limited to the toner and the image forming apparatus of the aforementioned embodiment and may be applied to any toner having at least mother particles and external additive particles and any image forming apparatus which uses the toner T.

Now, still another embodiment of the toner T of the present invention will be described. The toner T of this embodiment includes a plurality of mother particles 18 and a plurality of external additive particles 19 of external additives such as silica. The mother particles 18 is made of resin having a low softening point, thus is soft at ordinary temperature, and includes at least mother particles which are micro particles of 1.5–2.5 μm in diameter. The liberated mother particle ratio of liberated mother particles 18' which are mother particles without external additive particle 19 adhering thereto is set to be 15% or less. The liberated mother particle ratio is a percentage of the amount of the liberated mother particles 18' relative to the entire amount of the toner. In addition, the roundness of the micro particles as mother particles of 1.5–2.5 μm in diameter is set to be between 0.85 and 0.95.

The roundness of each mother particle 18 in the toner T of this embodiment can be measured in the same manner as the aforementioned embodiment. To obtain the liberation ratio in the toner, the particle analyzing method is employed in the same manner as the aforementioned embodiment.

In the present invention, the liberated additive particle ratios such as the liberated silica particle ratio are obtained from the state of adhesion of external additive particles 19 relative to the mother particles 18 of the toner T analyzed by using a distribution map indicating equivalent particle diameters as shown in FIG. 5.

Similarly to the toner T of the aforementioned embodiment, the toner T of this embodiment may be of a negative polarity or of a positive polarity. The mother particles comprises at least a coloring agent, an charge controlling agent, and other resin. Moreover, a dispersant, a releasing agent (WAX), a magnetic material, and other additives may be suitably added.

The mother particles 18, the coloring agent, the charge controlling agent, the releasing agent, the dispersant, the additives, and magnetic material used in the toner T of this embodiment may be the same as the mother particle material, the coloring agent, the charge controlling agent, the releasing agent, the dispersant, the additives, and magnetic material used in the toner T of the aforementioned embodiment.

The foregoing materials are formed into the mother particles 18 by the same method as used for forming the mother particles 18 of the toner T of the aforementioned embodiment.

The external additives 19 may be silica, titanium oxide, alumina, in addition, one or more selected from a group consisting of inorganic fine particles, for example, fine particles of metal oxide, fine particles of nitride, fine particles of carbide, fine particles of metallic salt, and composites thereof, and organic fine particles similarly to the toner T of the aforementioned embodiment. These may be used singly or in mixed state. As its surface treatment material, the same material as used for the toner of the aforementioned embodiment may be employed. Also similar to the aforementioned embodiment, it is preferable that the particle diameter of the external additives is 0.001 μm to 1 μm.

The mother particles 18 and the external additives 19 are mixed in a dry state so as to adhere to one another by using a mixer in the same manner as the toner T of the aforementioned embodiment.

According to the toner T of this embodiment as mentioned above, the liberated mother particle ratio is set to be 15% or less in the toner of which the roundness of the micro particles of 1.5–2.5 μm as mother particles 18 is set to be between 0.85 and 0.95. Therefore, in a toner having a liberated mother particle ratio of 15% or less, the roundness of the micro particles as mother particles can be suitably highly set, thereby reducing possibility of fusion of liberated mother particles to the toner-contact members such as the latent image carrier, the toner carrier, and the toner regulating member. In addition, uniform adhesion of external additive particles to the mother particles which are micro particles is achieved, thereby effectively reducing possibility of fusion of the micro particles as mother particles on the toner-contact members. As a result, the occurrence of filming on the toner-contact members is effectively prevented. According to the toner T of this embodiment, the durability of the toner contact members such as the latent image carrier, the toner carrier, and the toner regulating blade can be improved and high-quality images can be obtained over a long period.

In the toner of this embodiment, silica is used as the external additive 19 and, in addition, a suitable amount of silica particles can adhere to the mother particles 18, thereby preventing a large quantity of heat for heat fixing from being consumed by the silica particles 19. In addition, the mother particles 18 are coated with a desired amount of silica particles 19, thus preventing the surfaces of the mother particles having a low melting point from being over-exposed. Therefore, according to the toner T of this embodiment, the filming of the toner T onto the toner-contact members can be prevented and the low-temperature fixing property can be improved.

In the image forming apparatus 1 of this embodiment by using the toner T, the durability of the photoreceptor 2, the developing roller 16, and the toner regulating blade 17 can be improved and high-quality images can be obtained over a long period.

In addition, heat can be hardly transferred to mother particles 18 having a low melting point. Therefore, according to the toner T of this embodiment, the fusion of the toner T onto the photoreceptor 2, the developing roller 16, and the toner regulating blade 17 can be prevented and the low-temperature fixing property can be improved.

Actually, experiments for measurements of filming of toner on the developing roller 16, and the toner regulating blade 17 were conducted as for toners of Examples 15 through 17 of the present invention and also toners of Comparative Examples 13 and 14 for comparison to Examples 15 through 17. Toners used in the experiments, additive adhesion condition, and results of the experiments are shown in Table 6. The results were evaluated as follows. When there is no filming of toner T on any of the developing roller 16, and the toner regulating blade 17 even after printing 10K (1K=1000) sheets of paper, "Good" was given for evaluation. When there is any filming of toner T on either one of the developing roller 16, and the toner regulating blade 17 before printed 10K sheets of paper, "No Good" was given for evaluation.

TABLE 6

| | | Example 15 | Example 16 | Example 17 | Comparative Example 13 | Comparative Example 14 |
|---|---|---|---|---|---|---|
| Mother Particles | | Polymerized Toner | Pulverized Toner← | Pulverized Rounded Toner | Pulverized Toner | Pulverized Toner |
| Silica | | TG810G*1 | ← | ← | ← | ← |
| Additive Adhesion | Mixer | Henshel 20C*2 | ← | ← | ← | ← |
| Condition | Revolution Speed | 2850 rpm | ← | ← | ← | ← |
| | Time Period | 5 min | 4 min | 3 min | 1 min | 4 min |
| | Roundness of Mother Particle of 1.5–2.5 μm in diameter | 0.939 | 0.882 | 0.901 | 0.882 | 0.835 |
| | Roundness of Mother Particle of 1.5–2.5 μm in diameter | 0.963 | 0.918 | 0.918 | 0.918 | 0.902 |
| | Liberated Mother Particle Ratio % | 3.1 | 7.7 | 12.3 | 16.5 | 8.3 |
| Results | Filming on Toner Regulating Blade | ○ | ○ | ○ | X | ○ |
| | Filming on Developing Roller | ○ | ○ | ○ | ○ | X |
| | No. of Printable Sheets | 10K | 10K | 10K | 4K | 3K |

*1available from Cabot Corporation
*2available from Mitsui Mining Company, Ltd.
○: not occurred
X: occurred As shown in Table 6, the toner of Example 15 belonging to the present invention was a polymerized toner of which used mother particles 18 were prepared by polymerization, the toner of Example 16 belonging to the present invention and the toners of Comparative Examples 13 and 14 not belonging to the present invention were pulverized toners of which used mother particles were prepared by pulverization, and the toner of Example 17 belonging to the present invention was a pulverized rounded toner of which used mother particles 18 were prepared by the pulverization and processed by rounding treatment.

In every toner, silica was used as the external additive 19. In this case, the silica ($SiO_2$) was TG810G (available from Cabot Corporation). The examples were prepared under the same adhesion condition that a mixer used for adhesion of the silica particles to the mother particles 18 was Henshel 20C (manufactured by Mitsui Mining Company, Ltd.), and the revolution speed of the mixer was 2850 rpm.

The time period taken for the additive adhesion was five minutes in Example 15, four minutes in Example 16, three minutes in Example 17, one minute in Comparative Example 13, and four minutes in Comparative Example 14.

Moreover, the roundness of the micro particles of 1.5–2.5 μm as mother particles was 0.939 in Example 15, 0.882 in Example 16, 0.901 in Example 17, 0.882 in Comparative Example 13, and 0.835 in Comparative Example 14. The roundness of mother particles 1.5–40 μm was 0.963 in Example 15, 0.918 in Example 16, 0.918 in Example 17, 0.918 in Comparative Example 13, and 0.902 in Comparative Example 14.

The liberated mother particle ratio of mother particles without silica particle adhering thereto was 3.1% in Example 15, 7.7% in Example 16, 12.3% in Example 17, 16.5% in Comparative Example 13, and 8.3% in Comparative Example 14.

As apparent from Table 6, the toners T of Examples 15 through 17 had good results that no filming was observed on any of the developing roller 16, and the toner regulating blade 17 even after printing 10K sheets of paper. On the other hand, the toner T of Comparative Example 13 had no-good results that filming was observed on the toner regulating blade 17 when 4K sheets of paper were printed while no filming was observed on the developing roller 16. The toner T of Comparative Example 14 had also no-good results that filming was observed on the developing roller 16 when 3K sheets of paper were printed while no filming was observed on the toner regulating blade 17.

Accordingly, in a toner having micro particles as mother particles, by setting the liberated mother particle ratio to be 15% or less and setting the roundness of micro particles of 1.5–2.5 μm as mother particles to be 0.85–0.95, the filming on the toner-contact members such as the photoreceptor 2, the developing roller 16, and the toner regulating blade 17 can be effectively prevented.

Though liberated silica particle ratio is shown in Table 6 as the liberated additive particle ratio, the present invention may be applied to other liberated additive particle ratio. However, the liberated silica particle ratio is preferable to be adapted as the liberated additive particle ratio of the present invention because the aforementioned works and effects can be securely obtained.

It should be noted that the present invention is not limited to the toner and the image forming apparatus of the aforementioned embodiment and may be applied to any toner having at least mother particles and external additive particles and any image forming apparatus which uses the toner T.

Now, yet another embodiment of the toner T of the present invention will be described. The toner T of this embodiment includes a plurality of mother particles 18 and a plurality of external additive particles 19. The mother particles 18 is made of resin having a low softening point, thus is soft at ordinary temperature, and the external additive particles 19 include at least silica particles and titanium oxide particles. The external additive particles are set such that the absolute deviation in synchronous distribution of the silica particles relative to the mother particles is smaller than the absolute deviation in synchronous distribution of the titanium oxide particles relative to the mother particles. It should be noted that the synchronization of external additive particles 19 relative to the mother particles 18 means a state that the external additive particles 19 adhere to the mother particles 18 as will be described later.

The synchronous distribution of external additive particles relative to mother particles and its absolute deviation can be obtained by analyzing the state of adhesion of external additive particles 19 relative to the mother particles 18 of the toner. To analyze the adhesion of the toner T, the particle analyzing method is employed in the same manner as the aforementioned embodiments.

In the present invention, the liberated additive particle ratios such as the liberated silica particle ratio are obtained from the state of adhesion of external additive particles 19 relative to the mother particles 18 of the toner T analyzed by using a distribution map indicating equivalent particle diameters as shown in FIG. 5.

Similarly to the toner T of the aforementioned embodiment, the toner T of this embodiment may be of a negative polarity or of a positive polarity. The mother particles comprises at least a coloring agent, an charge controlling agent, and other resin. Moreover, a dispersant, a releasing agent (WAX), a magnetic material, and other additives may be suitably added.

The mother particles 18, the coloring agent, the charge controlling agent, the releasing agent, the dispersant, the additives, and magnetic material used in the toner T of this embodiment may be the same as the mother particle material, the coloring agent, the charge controlling agent, the releasing agent, the dispersant, the additives, and magnetic material used in the toner T of the aforementioned embodiment.

The foregoing materials are formed into the mother particles 18 by the same method as used for forming the mother particles 18 of the toner T of the aforementioned embodiment.

The external additives 19 may be silica, titanium oxide, alumina, in addition, one or more selected from a group consisting of inorganic fine particles, for example, fine particles of metal oxide, fine particles of nitride, fine particles of carbide, fine particles of metallic salt, and composites thereof, and organic fine particles similarly to the toner T of the aforementioned embodiment. These may be used singly or in mixed state. As its surface treatment material, the same material as used for the toner of the aforementioned embodiment may be employed. Also similar to the aforementioned embodiment, it is preferable that the particle diameter of the external additives is 0.001 μm to 1 μm.

The mother particles 18 and the external additives 19 are mixed in a dry state so as to adhere to one another by using a mixer in the same manner as the toner T of the aforementioned embodiment.

According to the toner T of this embodiment as mentioned above, the external additive particles are set such that the absolute deviation in synchronous distribution of the silica particles relative to the mother particles is smaller than the absolute deviation in synchronous distribution of the titanium oxide particles relative to the mother particles, thereby effectively preventing the occurrence of filming on the toner-contact members such as the developing roller 16, the toner regulating blade 17, and the photoreceptor 2, because of the function of silica for preventing occurrence of filming. In addition, the distribution of the titanium oxide particles having a charge control function is set to be larger than the distribution of the silica particles so that the titanium oxide particles easily move, thereby achieving uniform charge of the toner T because of the titanium oxide particles. According to the toner T of this embodiment, the filming on the toner contact members can be prevented and the charge uniformity of the toner can be improved.

In the image forming apparatus 1 of this embodiment, by using the toner T, the filming on the toner contact members can be prevented and the charge uniformity of the toner can be improved, thereby providing high-quality images.

Actually, experiments for measurements on the charging property were conducted as for toners of Examples 18 and 19 of the present invention and also toners of Comparative Examples 15 and 16 for comparison to Examples 18 and 19. Toners used in the experiments, additive adhesion condition, and results of the experiments are shown in Table 7. The results were evaluated according to the toner charge and the toner fogging after printing 1K (1K=1000) sheets of paper.

TABLE 7

| | | Example 18 | Example 19 | Comparative Example 15 | Comparative Example 16 |
|---|---|---|---|---|---|
| Mother Particles | | Pulverized Toners | ← | ← | ← |
| Additive Adhesion Condition (First Step) | Titanium Oxide | NKT90*2 | ← | ← | ← |
| | Mixer | Henshel 20C*3 | ← | ← | ← |
| | Revolution Speed | 2850 rpm | ← | ← | ← |
| | Adding Amount | 0.5 parts by weight | ← | ← | ← |
| | Time Period | 2 min | 3 min | 4 min | 3 min |
| Additive Adhesion Condition (Second Step) | Silica | TG810G*1 | ← | ← | ← |
| | Mixer | Henshel 20C*3 | ← | ← | ← |
| | Revolution Speed | 2850 rpm | ← | ← | ← |
| | Adding Amount | 1.0 parts by weight | ← | ← | ← |
| | Time Period | 4 min | 4 min | 2 min | 3 min |
| Absolute Deviation of Silica | | 0.08 | 0.10 | 0.17 | 0.15 |
| Absolute Deviation of Titanium Oxide | | 0.16 | 0.12 | 0.11 | 0.12 |
| Initial Toner Charge μc/g | | 15.6 | 14.2 | 14.0 | 15.4 |
| Results | Toner Charge after printing 1K μc/g | 15.4 | 13.6 | 8.9 | 11.2 |
| | Toner Fogging after printing 1K g/1K | 6.5 | 5.4 | 16.8 | 9.6 |

*1available from Cabot Corporation
*2available from Nippon Aerosil Co., Ltd
*3available from Mitsui Mining Co., Ltd.

As shown in Table 7, the toners of Examples 18 and 19 belonging to the present invention and the toners of Comparative Examples 15 and 16 not belonging to the present invention were pulverized toners of which used mother particles 18 were prepared by the pulverization.

As for every toner, adhesion of titanium oxide particles to mother particles was conducted as the first step, and adhesion of silica particles to the mother particles subjected to the first step was conducted as the second step. In the additive adhesion condition for the first step, as for every toner, titanium oxide ($TiO_2$) was used as an external additive 19 and the titanium oxide was NKT90 (available from Nippon Aerosil Company, Ltd.). Also as for every toner, a mixer used for adhesion of the titanium oxide particles to the mother particles 18 was Henshel 20C (manufactured by Mitsui Mining Company, Ltd.), the revolution speed of the mixer was 2850 rpm., and the adding amount was 0.5 parts by weight. The time period taken for the additive adhesion was two minutes in Example 18, three minutes in Example 19, four minutes in Comparative Example 15, and three minutes in Comparative Example 16.

On the other hand, in the additive adhesion condition for the second step, silica ($SiO_2$) was used as another external additive 19 and the silica was TG810G (available from Cabot Corporation). Also as for every toner, a mixer used for adhesion of the silica particles to the mother particles 18 with the titanium oxide particles adhering thereto was Henshel 20C (manufactured by Mitsui Mining Company, Ltd.), the revolution speed of the mixer was 2850 rpm., and the adding amount was 1.0 parts by weight. The time period taken for the additive adhesion was four minutes in Example 18, four minutes in Example 19, two minutes in Comparative Example 15, and three minutes in Comparative Example 16.

The absolute deviation of silica was 0.08 in Example 18, 0.10 in Example 19, 0.17 in Comparative Example 15, and 0.15 in Comparative Example 16. The absolute deviation of titanium oxide was 0.16 in Example 18, 0.12 in Example 19, 0.11 in Comparative Example 15, and 0.12 in Comparative Example 16.

The initial toner charge was 15.6 μc/g in Example 18, 14.2 μc/g in Example 19, 14.0 μc/g in Comparative Example 15, and 15.4 μc/g in Comparative Example 16.

As apparent from Table 7, the toners T of Example 18 had a good result that the toner charge after printing 1K sheets of paper was 15.4 μc/g that was slightly smaller than the initial toner charge and the difference therebetween was little. This means that the toner has stable charging property. The toner T of Example 19 had a good result that the toner charge after printing 1K sheets of paper was 13.6 μc/g that was slightly smaller than the initial toner charge and the difference therebetween was little just like Example 18. This means that the toner has stable charging property.

To the contrary, the toner T of Comparative Example 15 had a no-good result that the toner charge after printing 1K sheets of paper was 8.9 μc/g that was significantly smaller than the initial toner charge and the difference therebetween was marked. This means that the toner has unstable charging property. The toner of Comparative Example 16 had a no-good result that the toner charge after printing 1K sheets of paper was 11.2 μc/g that was significantly smaller than the initial toner charge and the difference therebetween was marked just like Comparative Example 15. This means that the toner has unstable charging property.

Moreover, the toner T of Example 18 had also a good result that the toner fogging after printing 1K sheets of paper was 6.5 g/1K that was relatively small. The toner T of Example 19 had also a good result that the toner fogging after printing 1K sheets of paper was 5.4 g/1K that was similarly relatively small.

To the contrary, the toner T of Comparative Example 15 had also a no-good result that the toner fogging after printing 1K sheets of paper was 16.7 g/1K that was relatively large. The toner T of Comparative Example 16 had also a no-good result that the toner fogging after printing 1K sheets of paper was 9.6/1K that was relatively large.

Accordingly, by setting the absolute deviation in the synchronous distribution of the silica particles relative to the mother particles to be smaller than the absolute deviation in the synchronous distribution of the titanium oxide particles relative to the mother particles, the filming on the toner-contact members such as the developing roller 16, the toner regulating blade 17, and the photoreceptor 2 can be prevented and the stable charging property can be obtained.

Though the mother particles used in the above experiments were pulverized toner particles prepared by the pulverization, the present invention can be applied to mother particles prepared by another preparation method.

It should be noted that the present invention is not limited to the toner and the image forming apparatus of the aforementioned embodiment and may be applied to any toner T having at least mother particles and external additive particles and any image forming apparatus which uses the toner T.

I claim:

1. A toner comprising, at least, a plurality of mother particles and a plurality of external additive particles, wherein said external additive particles contain at least silica particles and titanium oxide particles, and said external additive particles are set such that the absolute deviation in synchronous distribution of said silica particles relative to said mother particles is smaller than the absolute deviation in synchronous distribution of said titanium oxide particles relative to said mother particles.

2. The toner as claimed in claim 1, wherein the absolute deviation in synchronous distribution of said titanium oxide particles relative to said mother particles is at least 20% higher than the absolute deviation in synchronous distribution of said silica particles relative to said mother particles.

3. The toner as claimed in claim 1, wherein the absolute deviation in synchronous distribution of said titanium oxide particles relative to said mother particles is at least twice the absolute deviation in synchronous distribution of said silica particles relative to said mother particles.

4. The toner as claimed in claim 1, wherein the toner has a first toner charge before printing any sheets of a recording medium, wherein the toner has a second toner charge after printing a predetermined number of the sheets of the recording medium, and wherein the second toner charge is least 95% of the first toner charge.

5. The toner as claimed in claim 1, wherein the toner has a first toner charge before printing any sheets of a recording medium, wherein the toner has a second toner charge after printing a predetermined number of the sheets of the recording medium, and wherein the second toner charge is least 98% of the first toner charge.

6. The toner as claimed in claim 4, wherein the predetermined number is 1000.

7. The toner as claimed in claim 6, wherein the predetermined number is 1000.

8. The toner as claimed in claim 1, wherein the toner has a toner charge (measured in μc/g) after printing a predetermined number of the sheets of the recording medium, wherein the toner experiences toner fogging (measured in (g)/(the predetermined number of sheets)) after printing the predetermined number of sheets, and wherein a ratio of the toner fogging to the toner charge is less than one.

9. The toner as claimed in claim 8, wherein the ratio of the toner fogging to the toner charge is less than 0.43.

10. The toner as claimed in claim 8, wherein the ratio of the toner fogging to the toner charge is less than 0.40.

11. The toner as claimed in claim 8, wherein the predetermined number is 1000.

* * * * *